US009048583B2

(12) United States Patent
Johnescu et al.

(10) Patent No.: US 9,048,583 B2
(45) Date of Patent: Jun. 2, 2015

(54) ELECTRICAL CONNECTOR HAVING RIBBED GROUND PLATE

(71) Applicants: Douglas M. Johnescu, York, PA (US); Jonathan E. Buck, Hershey, PA (US)

(72) Inventors: Douglas M. Johnescu, York, PA (US); Jonathan E. Buck, Hershey, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 13/755,628

(22) Filed: Jan. 31, 2013

(65) Prior Publication Data

US 2013/0149881 A1 Jun. 13, 2013

Related U.S. Application Data

(63) Continuation of application No. 12/722,797, filed on Mar. 12, 2010, now Pat. No. 8,366,485.

(60) Provisional application No. 61/161,687, filed on Mar. 19, 2009.

(51) Int. Cl.
*H01R 13/648* (2006.01)
*H01R 12/72* (2011.01)
(Continued)

(52) U.S. Cl.
CPC ..... *H01R 13/648* (2013.01); *H01R 12/724* (2013.01); *H01R 13/514* (2013.01); *H01R13/6474* (2013.01); *H01R 13/6586* (2013.01); *H01R 43/18* (2013.01); *Y10T 29/49204* (2015.01); *Y10T 29/49208* (2015.01)

(58) Field of Classification Search
USPC ..... 439/607.06–607.09, 108
See application file for complete search history.

(56) References Cited

U.S. PATENT DOCUMENTS 318,186 A 5/1885 Hertzog
741,052 A 10/1903 Mahon
(Continued)

FOREIGN PATENT DOCUMENTS

DE 1665181 4/1974
DE 3529218 2/1986
(Continued)

OTHER PUBLICATIONS

European Patent Application No. 10753953.8: Extended European Search Report dated Nov. 7, 2013, 6 pages.
(Continued)

*Primary Examiner* — Hien Vu
(74) *Attorney, Agent, or Firm* — Baker & Hostetler LLP

(57) ABSTRACT

An electrical connector includes a dielectric housing, a plurality of electrical signal contacts carried by the dielectric housing, and a ground plate carried by the dielectric housing. The electrical signal contacts are arranged along a first plane, wherein the signal contacts define signal pairs such that a respective gap is disposed between adjacent signal pairs. The signal contacts further define respective mating and mounting ends. The ground plate includes a ground plate body oriented in a second plane that is substantially parallel to the first plane and offset from the first plane. The ground plate body defines first and second opposed surfaces. The ground plate includes at least one rib that defines first and second opposed surfaces, wherein the first surface of the rib projects from the first surface of the ground plate body in a direction toward the gap, and the second surface is recessed into the second surface of the ground plate body. The ground plate further includes a plurality of mating ends and mounting ends extending from the ground plate body and disposed in the first plane so as to be aligned with the respective mating ends and mounting ends of the electrical signal contacts.

10 Claims, 11 Drawing Sheets

(51) Int. Cl.

| | |
|---|---|
| ***H01R 13/514*** | (2006.01) |
| ***H01R 13/6474*** | (2011.01) |
| ***H01R 13/6586*** | (2011.01) |
| ***H01R 43/18*** | (2006.01) |

(56) References Cited

U.S. PATENT DOCUMENTS

| | | | |
|---|---|---|---|
| 1,477,527 | A | 12/1923 | Raettig |
| D86,515 | S | 3/1932 | Cox |
| 2,231,347 | A | 2/1941 | Reutter |
| 2,248,675 | A | 7/1941 | Huppert |
| 2,430,011 | A | 11/1947 | Gillentine |
| 2,664,552 | A | 12/1953 | Ericsson et al. |
| 2,759,163 | A | 8/1956 | Ustin et al. |
| 2,762,022 | A | 9/1956 | Benander et al. |
| 2,849,700 | A | 4/1958 | Perkin |
| 2,844,644 | A | 7/1958 | Soule, Jr. |
| 2,858,372 | A | 10/1958 | Kaufman |
| 3,011,143 | A | 11/1961 | Dean |
| 3,115,379 | A | 12/1963 | McKee |
| 3,178,669 | A | 4/1965 | Roberts |
| 3,179,738 | A | 4/1965 | De Lyon |
| 3,208,030 | A | 9/1965 | Evans et al. |
| 3,286,220 | A | 11/1966 | Marley et al. |
| 3,320,658 | A | 5/1967 | Bolda et al. |
| 3,343,120 | A | 9/1967 | Whiting |
| 3,366,729 | A | 1/1968 | Pauza |
| 3,411,127 | A | 11/1968 | Adams |
| 3,420,087 | A | 1/1969 | Hatfield et al. |
| D213,697 | S | 4/1969 | Oxley |
| 3,482,201 | A | 12/1969 | Schneck |
| 3,514,740 | A | 5/1970 | Filson et al. |
| 3,538,486 | A | 11/1970 | Shlesinger, Jr. |
| 3,560,908 | A | 2/1971 | Dell et al. |
| 3,591,834 | A | 7/1971 | Kolias |
| 3,634,811 | A | 1/1972 | Teagno |
| 3,641,475 | A | 2/1972 | Irish et al. |
| 3,663,925 | A | 5/1972 | Proctor |
| 3,669,054 | A | 6/1972 | Desso et al. |
| 3,692,994 | A | 9/1972 | Hirschman et al. |
| 3,701,076 | A | 10/1972 | Irish |
| 3,719,981 | A | 3/1973 | Steitz |
| 3,732,697 | A | 5/1973 | Dickson |
| 3,748,633 | A | 7/1973 | Lundergan |
| 3,827,005 | A | 7/1974 | Friend |
| 3,845,451 | A | 10/1974 | Neidecker |
| 3,864,004 | A | 2/1975 | Friend |
| 3,865,462 | A | 2/1975 | Cobaugh et al. |
| 3,867,008 | A | 2/1975 | Gartland, Jr. |
| 3,871,015 | A | 3/1975 | Lin et al. |
| 3,889,364 | A | 6/1975 | Krueger |
| 3,942,856 | A | 3/1976 | Mindheim et al. |
| 3,972,580 | A | 8/1976 | Pemberton et al. |
| 4,030,792 | A | 6/1977 | Fuerst |
| 4,056,302 | A | 11/1977 | Braun et al. |
| 4,070,088 | A | 1/1978 | Vaden |
| 4,076,362 | A | 2/1978 | Ichimura |
| 4,082,407 | A | 4/1978 | Smorzaniuk et al. |
| 4,097,266 | A | 6/1978 | Takahashi et al. |
| 4,136,919 | A | 1/1979 | Howard et al. |
| 4,140,361 | A | 2/1979 | Sochor |
| 4,159,861 | A | 7/1979 | Anhalt |
| 4,217,024 | A | 8/1980 | Aldridge et al. |
| 4,232,924 | A | 11/1980 | Kline et al. |
| 4,260,212 | A | 4/1981 | Ritchie et al. |
| 4,274,700 | A | 6/1981 | Keglewitsch et al. |
| 4,288,139 | A | 9/1981 | Cobaugh et al. |
| 4,371,912 | A | 2/1983 | Guzik |
| 4,380,518 | A | 4/1983 | Wydro, Sr. |
| 4,383,724 | A | 5/1983 | Verhoeven |
| 4,395,086 | A | 7/1983 | Marsh |
| 4,396,140 | A | 8/1983 | Jaffe et al. |
| 4,402,563 | A | 9/1983 | Sinclair |
| 4,403,821 | A | 9/1983 | Zimmerman et al. |
| 4,448,467 | A | 5/1984 | Weidler |
| 4,462,534 | A | 7/1984 | Bitaillou et al. |
| 4,464,003 | A | 8/1984 | Goodman et al. |
| 4,473,113 | A | 9/1984 | Whitfield et al. |
| 4,473,477 | A | 9/1984 | Beall |
| D275,849 | S | 10/1984 | Sakurai |
| 4,482,937 | A | 11/1984 | Berg |
| 4,505,529 | A | 3/1985 | Barkus |
| 4,523,296 | A | 6/1985 | Healy, Jr. |
| 4,533,187 | A | 8/1985 | Kirkman |
| 4,536,955 | A | 8/1985 | Gudgeon |
| 4,545,610 | A | 10/1985 | Lakritz et al. |
| 4,552,425 | A | 11/1985 | Billman |
| 4,560,222 | A | 12/1985 | Dambach |
| 4,564,259 | A | 1/1986 | Vandame |
| 4,592,846 | A | 6/1986 | Metzger et al. |
| 4,596,428 | A | 6/1986 | Tengler |
| 4,596,433 | A | 6/1986 | Oesterheld et al. |
| 4,624,604 | A | 11/1986 | Wagner et al. |
| 4,632,476 | A | 12/1986 | Schell |
| 4,641,426 | A | 2/1987 | Hartman et al. |
| 4,655,515 | A | 4/1987 | Hamsher, Jr. et al. |
| 4,664,309 | A | 5/1987 | Allen et al. |
| 4,664,456 | A | 5/1987 | Blair et al. |
| 4,664,458 | A | 5/1987 | Worth |
| 4,678,250 | A | 7/1987 | Romine et al. |
| 4,685,886 | A | 8/1987 | Denlinger et al. |
| 4,705,205 | A | 11/1987 | Allen et al. |
| 4,705,332 | A | 11/1987 | Sadigh-Behzadi |
| 4,717,360 | A | 1/1988 | Czaja |
| 4,722,470 | A | 2/1988 | Johary |
| 4,762,500 | A | 8/1988 | Dola et al. |
| 4,767,344 | A | 8/1988 | Noschese |
| 4,776,803 | A | 10/1988 | Pretchel et al. |
| 4,782,893 | A | 11/1988 | Thomas |
| 4,790,763 | A | 12/1988 | Weber et al. |
| 4,806,107 | A | 2/1989 | Arnold et al. |
| 4,815,987 | A | 3/1989 | Kawano et al. |
| 4,818,237 | A | 4/1989 | Weber |
| 4,820,169 | A | 4/1989 | Weber et al. |
| 4,820,182 | A | 4/1989 | Harwath et al. |
| 4,824,383 | A | 4/1989 | Lemke |
| 4,830,264 | A | 5/1989 | Bitaillou et al. |
| 4,836,791 | A | 6/1989 | Grabbe et al. |
| 4,844,813 | A | 7/1989 | Helfgott et al. |
| 4,846,727 | A | 7/1989 | Glover et al. |
| 4,850,887 | A | 7/1989 | Sugawara |
| 4,854,899 | A | 8/1989 | Matthews |
| 4,867,713 | A | 9/1989 | Ozu et al. |
| 4,871,110 | A | 10/1989 | Fukasawa et al. |
| 4,878,611 | A | 11/1989 | LoVasco et al. |
| 4,881,905 | A | 11/1989 | Demler et al. |
| 4,882,554 | A | 11/1989 | Akaba et al. |
| 4,884,335 | A | 12/1989 | McCoy et al. |
| 4,898,539 | A | 2/1990 | Glover et al. |
| 4,900,271 | A | 2/1990 | Colleran et al. |
| 4,904,212 | A | 2/1990 | Durbin et al. |
| 4,907,990 | A | 3/1990 | Bertho et al. |
| 4,908,129 | A | 3/1990 | Finsterwalder et al. |
| 4,913,664 | A | 4/1990 | Dixon et al. |
| 4,915,641 | A | 4/1990 | Miskin et al. |
| 4,917,616 | A | 4/1990 | Demler, Jr. et al. |
| 4,952,172 | A | 8/1990 | Barkus et al. |
| 4,963,102 | A | 10/1990 | Gettig et al. |
| 4,965,699 | A | 10/1990 | Jorden et al. |
| 4,973,257 | A | 11/1990 | Lhotak |
| 4,973,271 | A | 11/1990 | Ishizuka et al. |
| 4,974,119 | A | 11/1990 | Martin |
| 4,975,069 | A | 12/1990 | Fedder et al. |
| 4,975,084 | A | 12/1990 | Fedder et al. |
| 4,979,074 | A | 12/1990 | Morley et al. |
| 4,997,390 | A | 3/1991 | Scholz et al. |
| 5,004,426 | A | 4/1991 | Barnett |
| 5,016,968 | A | 5/1991 | Hammond et al. |
| 5,024,372 | A | 6/1991 | Altman et al. |
| 5,024,610 | A | 6/1991 | French et al. |
| 5,035,631 | A | 7/1991 | Piorunneck et al. |
| 5,035,639 | A | 7/1991 | Kilpatrick et al. |
| 5,046,960 | A | 9/1991 | Fedder |
| 5,052,953 | A | 10/1991 | Weber |

(56) References Cited

U.S. PATENT DOCUMENTS 5,055,054 A 10/1991 Doutrich
5,060,844 A 10/1991 Behun et al.
5,065,282 A 11/1991 Polonio
5,066,236 A 11/1991 Broeksteeg
5,077,893 A 1/1992 Mosquera et al.
5,082,459 A 1/1992 Billman et al.
5,083,238 A 1/1992 Bousman
5,093,986 A 3/1992 Mandai et al.
5,094,623 A 3/1992 Scharf et al.
5,094,634 A 3/1992 Dixon et al.
5,098,311 A 3/1992 Roath et al.
5,104,332 A 4/1992 McCoy
5,104,341 A 4/1992 Gilissen et al.
5,111,991 A 5/1992 Clawson et al.
5,117,331 A 5/1992 Gebara
5,118,027 A 6/1992 Braun et al.
5,120,237 A 6/1992 Fussell
5,127,839 A 7/1992 Korsunsky et al.
5,131,871 A 7/1992 Banakis et al.
5,137,959 A 8/1992 Block et al.
5,139,426 A 8/1992 Barkus et al.
5,145,104 A 9/1992 Apap et al.
5,151,056 A 9/1992 McClune
5,152,700 A 10/1992 Bogursky et al.
5,161,987 A 11/1992 Sinisi
5,163,337 A 11/1992 Herron et al.
5,163,849 A 11/1992 Fogg et al.
5,167,528 A 12/1992 Nishiyama et al.
5,169,337 A 12/1992 Ortega et al.
5,174,770 A 12/1992 Sasaki et al.
5,181,855 A 1/1993 Mosquera et al.
5,194,480 A 3/1993 Block et al.
5,199,885 A 4/1993 Korsunsky et al.
5,203,075 A 4/1993 Angulas et al.
5,207,372 A 5/1993 Funari et al.
5,213,868 A 5/1993 Liberty et al.
5,214,308 A 5/1993 Nishiguchi
5,217,381 A 6/1993 Zell et al.
5,222,649 A 6/1993 Funari et al.
5,224,867 A 7/1993 Ohtsuki et al.
5,228,864 A 7/1993 Fusselman et al.
5,229,016 A 7/1993 Hayes et al.
5,238,414 A 8/1993 Yaegashi et al.
5,254,012 A 10/1993 Wang
5,255,839 A 10/1993 Da Costa Alves et al.
5,257,941 A 11/1993 Lwee et al.
5,261,155 A 11/1993 Angulas et al.
5,269,453 A 12/1993 Melton et al.
5,274,918 A 1/1994 Reed
5,275,330 A 1/1994 Isaacs et al.
5,276,964 A 1/1994 Anderson, Jr. et al.
5,277,624 A 1/1994 Champion et al.
5,284,287 A 2/1994 Wilson et al.
5,285,163 A 2/1994 Liotta
5,286,212 A 2/1994 Broeksteeg
5,288,949 A 2/1994 Crafts
5,295,843 A 3/1994 Davis et al.
5,298,791 A 3/1994 Liberty et al.
5,302,135 A 4/1994 Lee
5,321,582 A 6/1994 Casperson
5,324,569 A 6/1994 Nagesh et al.
5,342,211 A 8/1994 Broeksteeg
5,344,327 A 9/1994 Brunker et al.
5,346,118 A 9/1994 Degani et al.
5,354,219 A 10/1994 Wanjura
5,355,283 A 10/1994 Marrs et al.
5,356,300 A 10/1994 Costello et al.
5,356,301 A 10/1994 Champion et al.
5,357,050 A 10/1994 Baran et al.
5,358,417 A 10/1994 Schmedding
5,377,902 A 1/1995 Hayes
5,381,314 A 1/1995 Rudy, Jr. et al.
5,382,168 A 1/1995 Azuma et al.
D355,409 S 2/1995 Krokaugger
5,387,111 A 2/1995 DeSantis et al.
5,387,139 A 2/1995 McKee et al.
5,395,250 A 3/1995 Englert, Jr. et al.
5,400,949 A 3/1995 Hirvonen et al.
5,403,206 A 4/1995 McNamara et al.
5,409,157 A 4/1995 Nagesh et al.
5,410,807 A 5/1995 Bross et al.
5,427,543 A 6/1995 Dynia
5,429,520 A 7/1995 Morlion et al.
5,429,521 A 7/1995 Morlion et al.
5,431,332 A 7/1995 Kirby et al.
5,431,578 A 7/1995 Wayne
5,433,617 A 7/1995 Morlion et al.
5,433,618 A 7/1995 Morlion et al.
5,435,482 A 7/1995 Variot et al.
5,442,852 A 8/1995 Danner
5,445,313 A 8/1995 Boyd et al.
5,457,342 A 10/1995 Herbst, II
5,458,426 A 10/1995 Ito
5,462,456 A 10/1995 Howell
5,467,913 A 11/1995 Namekawa et al.
5,474,472 A 12/1995 Niwa et al.
5,475,922 A 12/1995 Tamura et al.
5,477,933 A 12/1995 Nguyen
5,489,750 A 2/1996 Sakemi et al.
5,490,040 A 2/1996 Gaudenzi et al.
5,491,303 A 2/1996 Weiss
5,492,266 A 2/1996 Hoebener et al.
5,495,668 A 3/1996 Furusawa et al.
5,496,183 A 3/1996 Soes et al.
5,498,167 A 3/1996 Seto et al.
5,499,487 A 3/1996 McGill
5,504,277 A 4/1996 Danner
5,511,987 A 4/1996 Shinchi
5,512,519 A 4/1996 Hwang
5,516,030 A 5/1996 Denton
5,516,032 A 5/1996 Sakemi et al.
5,518,410 A 5/1996 Masami
5,519,580 A 5/1996 Natarajan et al.
5,522,727 A 6/1996 Saito et al.
5,533,915 A 7/1996 Deans
5,534,127 A 7/1996 Sakai
5,539,153 A 7/1996 Schwiebert et al.
5,542,174 A 8/1996 Chiu
5,558,542 A 9/1996 O'Sullivan et al.
5,564,952 A 10/1996 Davis et al.
5,575,688 A 11/1996 Crane, Jr.
5,577,928 A 11/1996 Duclos
5,580,283 A 12/1996 O'Sullivan et al.
5,586,908 A 12/1996 Lorrain
5,586,914 A 12/1996 Foster, Jr. et al.
5,588,859 A 12/1996 Maurice
5,590,463 A 1/1997 Feldman et al.
5,591,118 A 1/1997 Bierck
5,591,941 A 1/1997 Acocella et al.
5,593,322 A 1/1997 Swamy et al.
5,605,417 A 2/1997 Englert et al.
5,609,502 A 3/1997 Thumma
5,613,882 A 3/1997 Hnatuck et al.
5,618,187 A 4/1997 Goto
5,634,821 A 6/1997 Crane, Jr.
5,637,008 A 6/1997 Kozel
5,637,019 A 6/1997 Crane, Jr. et al.
5,643,009 A 7/1997 Dinkel et al.
5,664,968 A 9/1997 Mickievicz
5,664,973 A 9/1997 Emmert et al.
5,667,392 A 9/1997 Kocher et al.
5,672,064 A 9/1997 Provencher et al.
5,691,041 A 11/1997 Frankeny et al.
D387,733 S 12/1997 Lee
5,697,799 A 12/1997 Consoli et al.
5,702,255 A 12/1997 Murphy et al.
5,713,746 A 2/1998 Olson et al.
5,718,606 A 2/1998 Rigby et al.
5,727,963 A 3/1998 LeMaster
5,730,609 A 3/1998 Harwath
5,733,453 A 3/1998 DeBusk
5,741,144 A 4/1998 Elco et al.
5,741,161 A 4/1998 Cahaly et al.
5,742,484 A 4/1998 Gillette et al.

(56) References Cited

U.S. PATENT DOCUMENTS

| | | | |
|---|---|---|---|
| 5,743,009 | A | 4/1998 | Matsui et al. |
| 5,743,765 | A | 4/1998 | Andrews et al. |
| 5,745,349 | A | 4/1998 | Lemke |
| 5,746,608 | A | 5/1998 | Taylor |
| 5,749,746 | A | 5/1998 | Tan et al. |
| 5,755,595 | A | 5/1998 | Davis et al. |
| 5,766,023 | A | 6/1998 | Noschese et al. |
| 5,772,451 | A | 6/1998 | Dozier, II et al. |
| 5,782,644 | A | 7/1998 | Kiat |
| 5,787,971 | A | 8/1998 | Dodson |
| 5,795,191 | A | 8/1998 | Preputnick et al. |
| 5,810,607 | A | 9/1998 | Shih et al. |
| 5,817,973 | A | 10/1998 | Elco |
| 5,827,094 | A | 10/1998 | Aizawa et al. |
| 5,831,314 | A | 11/1998 | Wen |
| 5,833,475 | A | 11/1998 | Mitra |
| 5,846,024 | A | 12/1998 | Mao et al. |
| 5,851,121 | A | 12/1998 | Thenaisie et al. |
| 5,853,797 | A | 12/1998 | Fuchs et al. |
| 5,857,857 | A | 1/1999 | Fukuda |
| 5,860,816 | A | 1/1999 | Provencher et al. |
| 5,871,362 | A | 2/1999 | Campbell et al. |
| 5,874,776 | A | 2/1999 | Kresge et al. |
| 5,876,219 | A | 3/1999 | Taylor |
| 5,876,222 | A | 3/1999 | Gardner et al. |
| 5,876,248 | A | 3/1999 | Brunker et al. |
| 5,882,214 | A | 3/1999 | Hillbish et al. |
| 5,883,782 | A | 3/1999 | Thurston et al. |
| 5,887,158 | A | 3/1999 | Sample et al. |
| 5,888,884 | A | 3/1999 | Wojnarowski |
| 5,892,791 | A | 4/1999 | Moon |
| 5,893,761 | A | 4/1999 | Longueville |
| 5,902,136 | A | 5/1999 | Lemke et al. |
| 5,904,581 | A | 5/1999 | Pope et al. |
| 5,908,333 | A | 6/1999 | Perino et al. |
| 5,913,702 | A | 6/1999 | Garcin |
| 5,919,050 | A | 7/1999 | Kehley et al. |
| 5,930,114 | A | 7/1999 | Kuzmin et al. |
| 5,938,479 | A | 8/1999 | Paulson et al. |
| 5,943,770 | A | 8/1999 | Thenaisie et al. |
| 5,955,888 | A | 9/1999 | Frederickson et al. |
| 5,961,355 | A | 10/1999 | Morlion et al. |
| 5,967,844 | A | 10/1999 | Doutrich et al. |
| 5,971,817 | A | 10/1999 | Longueville |
| 5,975,921 | A | 11/1999 | Shuey |
| 5,980,270 | A | 11/1999 | Fjelstad et al. |
| 5,980,321 | A | 11/1999 | Cohen et al. |
| 5,982,249 | A | 11/1999 | Bruns |
| 5,984,690 | A | 11/1999 | Riechelmann et al. |
| 5,984,726 | A | 11/1999 | Wu |
| 5,992,953 | A | 11/1999 | Rabinovitz |
| 5,993,259 | A | 11/1999 | Stokoe et al. |
| 6,012,948 | A | 1/2000 | Wu |
| 6,022,227 | A | 2/2000 | Huang |
| 6,024,584 | A | 2/2000 | Lemke et al. |
| 6,027,381 | A | 2/2000 | Lok |
| 6,036,549 | A | 3/2000 | Wulff |
| 6,041,498 | A | 3/2000 | Hillbish et al. |
| 6,042,389 | A | 3/2000 | Lemke et al. |
| 6,042,394 | A | 3/2000 | Mitra et al. |
| 6,042,427 | A | 3/2000 | Adriaenssens et al. |
| 6,050,842 | A | 4/2000 | Ferrill et al. |
| 6,050,862 | A | 4/2000 | Ishii |
| 6,053,751 | A | 4/2000 | Humphrey |
| 6,059,170 | A | 5/2000 | Jimarez et al. |
| 6,066,048 | A | 5/2000 | Lees |
| 6,068,520 | A | 5/2000 | Winings et al. |
| 6,071,152 | A | 6/2000 | Achammer et al. |
| 6,077,130 | A | 6/2000 | Hughes et al. |
| 6,083,047 | A | 7/2000 | Paagman |
| 6,086,386 | A | 7/2000 | Fjelstad et al. |
| 6,089,878 | A | 7/2000 | Meng |
| 6,095,827 | A | 8/2000 | Dutkowsky et al. |
| 6,113,418 | A | 9/2000 | Kjeldahl |
| 6,116,926 | A | 9/2000 | Ortega et al. |
| 6,116,965 | A | 9/2000 | Arnett et al. |
| 6,123,554 | A | 9/2000 | Ortega et al. |
| 6,125,535 | A | 10/2000 | Chiou et al. |
| 6,129,592 | A | 10/2000 | Mickievicz et al. |
| 6,132,255 | A | 10/2000 | Verhoeven |
| 6,139,336 | A | 10/2000 | Olson |
| 6,146,157 | A | 11/2000 | Lenoir et al. |
| 6,146,202 | A | 11/2000 | Ramey et al. |
| 6,146,203 | A | 11/2000 | Elco et al. |
| 6,152,747 | A | 11/2000 | McNamara |
| 6,152,756 | A | 11/2000 | Huang et al. |
| 6,154,742 | A | 11/2000 | Herriot |
| 6,171,115 | B1 | 1/2001 | Mickievicz et al. |
| 6,171,149 | B1 | 1/2001 | Van Zanten |
| 6,174,198 | B1 | 1/2001 | Wu et al. |
| 6,179,663 | B1 | 1/2001 | Bradley et al. |
| 6,180,891 | B1 | 1/2001 | Murdeshwar |
| 6,183,287 | B1 | 2/2001 | Po |
| 6,183,301 | B1 | 2/2001 | Paagman |
| 6,190,213 | B1 | 2/2001 | Reichart et al. |
| 6,193,537 | B1 | 2/2001 | Harper, Jr. et al. |
| 6,196,871 | B1 | 3/2001 | Szu |
| 6,202,916 | B1 | 3/2001 | Updike et al. |
| 6,206,722 | B1 | 3/2001 | Ko et al. |
| 6,206,735 | B1 | 3/2001 | Zanolli |
| 6,210,197 | B1 | 4/2001 | Yu |
| 6,210,240 | B1 | 4/2001 | Comerci et al. |
| 6,212,755 | B1 | 4/2001 | Shimada et al. |
| 6,215,180 | B1 | 4/2001 | Chen et al. |
| 6,219,913 | B1 | 4/2001 | Uchiyama |
| 6,220,884 | B1 | 4/2001 | Lin |
| 6,220,895 | B1 | 4/2001 | Lin |
| 6,220,896 | B1 | 4/2001 | Bertoncini et al. |
| 6,227,882 | B1 | 5/2001 | Ortega et al. |
| 6,231,391 | B1 | 5/2001 | Ramey et al. |
| 6,234,851 | B1 | 5/2001 | Phillips |
| 6,238,225 | B1 | 5/2001 | Middlehurst et al. |
| 6,241,535 | B1 | 6/2001 | Lemke et al. |
| 6,244,887 | B1 | 6/2001 | Commerci et al. |
| 6,257,478 | B1 | 7/2001 | Straub |
| 6,259,039 | B1 | 7/2001 | Chroneos, Jr. et al. |
| 6,261,132 | B1 | 7/2001 | Koseki et al. |
| 6,267,604 | B1 | 7/2001 | Mickievicz et al. |
| 6,269,539 | B1 | 8/2001 | Takahashi et al. |
| 6,274,474 | B1 | 8/2001 | Caletka et al. |
| 6,280,209 | B1 | 8/2001 | Bassler et al. |
| 6,280,230 | B1 | 8/2001 | Takase et al. |
| 6,280,809 | B1 | 8/2001 | Wang |
| 6,290,552 | B1 | 9/2001 | Saito et al. |
| 6,293,827 | B1 | 9/2001 | Stokoe |
| 6,299,483 | B1 | 10/2001 | Cohen et al. |
| 6,299,484 | B2 | 10/2001 | Van Woensel et al. |
| 6,299,492 | B1 | 10/2001 | Pierini et al. |
| 6,302,711 | B1 | 10/2001 | Ito |
| 6,309,245 | B1 | 10/2001 | Sweeney |
| 6,319,075 | B1 | 11/2001 | Clark et al. |
| 6,322,377 | B2 | 11/2001 | Middlehurst et al. |
| 6,322,379 | B1 | 11/2001 | Ortega et al. |
| 6,322,393 | B1 | 11/2001 | Doutrich et al. |
| 6,328,602 | B1 | 12/2001 | Yamasaki et al. |
| 6,338,635 | B1 | 1/2002 | Lee |
| 6,343,955 | B2 | 2/2002 | Billman et al. |
| 6,347,952 | B1 | 2/2002 | Hasegawa et al. |
| 6,347,962 | B1 | 2/2002 | Kline |
| 6,350,134 | B1 | 2/2002 | Fogg et al. |
| 6,354,877 | B1 | 3/2002 | Shuey et al. |
| 6,358,061 | B1 | 3/2002 | Regnier |
| 6,359,783 | B1 | 3/2002 | Noble |
| 6,360,940 | B1 | 3/2002 | Bolde et al. |
| 6,361,366 | B1 | 3/2002 | Shuey et al. |
| 6,361,376 | B1 | 3/2002 | Onoda |
| 6,362,961 | B1 | 3/2002 | Chiou |
| 6,363,607 | B1 | 4/2002 | Chen et al. |
| 6,364,710 | B1 | 4/2002 | Billman et al. |
| 6,371,773 | B1 | 4/2002 | Crofoot et al. |
| 6,371,813 | B2 * | 4/2002 | Ramey et al. ..... 439/607.05 |
| 6,375,478 | B1 | 4/2002 | Kikuchi |
| 6,375,508 | B1 | 4/2002 | Pickles et al. |
| 6,379,188 | B1 | 4/2002 | Cohen et al. |

(56) References Cited

U.S. PATENT DOCUMENTS

| | | | |
|---|---|---|---|
| 6,386,914 | B1 | 5/2002 | Collins et al. |
| 6,386,924 | B2 | 5/2002 | Long |
| 6,390,826 | B1 | 5/2002 | Affolter et al. |
| 6,394,818 | B1 | 5/2002 | Smalley, Jr. |
| 6,402,566 | B1 | 6/2002 | Middlehurst et al. |
| 6,409,543 | B1 | 6/2002 | Astbury, Jr. et al. |
| 6,414,248 | B1 | 7/2002 | Sundstrom |
| 6,420,778 | B1 | 7/2002 | Sinyansky |
| 6,428,328 | B2 | 8/2002 | Haba et al. |
| 6,431,914 | B1 | 8/2002 | Billman |
| 6,431,921 | B2 | 8/2002 | Saito et al. |
| 6,435,914 | B1 | 8/2002 | Billman |
| 6,450,829 | B1 | 9/2002 | Weisz-Margulescu |
| 6,457,983 | B1 | 10/2002 | Bassler et al. |
| 6,461,183 | B1 | 10/2002 | Ohkita et al. |
| 6,461,202 | B2 | 10/2002 | Kline |
| 6,464,529 | B1 | 10/2002 | Jensen et al. |
| 6,471,523 | B1 | 10/2002 | Shuey |
| 6,471,548 | B2 | 10/2002 | Bertoncini et al. |
| 6,472,474 | B2 | 10/2002 | Burkhardt et al. |
| 6,482,038 | B2 | 11/2002 | Olson |
| 6,485,330 | B1 | 11/2002 | Doutrich |
| 6,488,549 | B1 | 12/2002 | Weller et al. |
| 6,489,567 | B2 | 12/2002 | Zachrai |
| 6,491,545 | B1 | 12/2002 | Spiegel et al. |
| 6,494,734 | B1 | 12/2002 | Shuey |
| 6,503,103 | B1 | 1/2003 | Cohen et al. |
| 6,506,076 | B2 | 1/2003 | Cohen et al. |
| 6,506,081 | B2 | 1/2003 | Blanchfield et al. |
| 6,517,360 | B1 | 2/2003 | Cohen |
| 6,520,803 | B1 | 2/2003 | Dunn |
| 6,526,519 | B1 | 2/2003 | Cuthbert |
| 6,527,587 | B1 | 3/2003 | Ortega et al. |
| 6,527,588 | B2 | 3/2003 | Paagman |
| 6,528,737 | B1 | 3/2003 | Kwong et al. |
| 6,530,134 | B1 | 3/2003 | Laphan et al. |
| 6,537,086 | B1 | 3/2003 | Mac Mullin |
| 6,537,111 | B2 | 3/2003 | Brammer et al. |
| 6,540,522 | B2 | 4/2003 | Sipe |
| 6,540,558 | B1 | 4/2003 | Paagman |
| 6,540,559 | B1 | 4/2003 | Kemmick et al. |
| 6,544,046 | B1 | 4/2003 | Hahn et al. |
| 6,544,072 | B2 | 4/2003 | Olson |
| 6,547,066 | B2 | 4/2003 | Koch |
| 6,551,112 | B1 | 4/2003 | Li et al. |
| 6,551,140 | B2 | 4/2003 | Billman et al. |
| 6,554,647 | B1 | 4/2003 | Cohen et al. |
| 6,565,387 | B2 | 5/2003 | Cohen |
| 6,565,388 | B1 | 5/2003 | Van Woensel et al. |
| 6,572,409 | B2 | 6/2003 | Nitta et al. |
| 6,572,410 | B1 | 6/2003 | Volstorf et al. |
| 6,575,774 | B2 | 6/2003 | Ling et al. |
| 6,575,776 | B1 | 6/2003 | Conner et al. |
| 6,589,071 | B1 | 7/2003 | Lias et al. |
| 6,592,381 | B2 | 7/2003 | Cohen et al. |
| 6,602,095 | B2 | 8/2003 | Astbury, Jr. et al. |
| 6,604,967 | B2 | 8/2003 | Middlehurst et al. |
| 6,607,402 | B2 | 8/2003 | Cohen et al. |
| 6,623,310 | B1 | 9/2003 | Billman et al. |
| 6,629,854 | B2 | 10/2003 | Murakami |
| 6,633,490 | B2 | 10/2003 | Centola et al. |
| 6,641,411 | B1 | 11/2003 | Stoddard et al. |
| 6,641,825 | B2 | 11/2003 | Scholz et al. |
| 6,652,318 | B1 | 11/2003 | Winings et al. |
| 6,663,426 | B2 | 12/2003 | Hasircoglu et al. |
| 6,665,189 | B1 | 12/2003 | Lebo |
| 6,666,693 | B2 | 12/2003 | Belopolsky et al. |
| 6,669,514 | B2 | 12/2003 | Wiebking et al. |
| 6,672,884 | B1 | 1/2004 | Toh et al. |
| 6,672,907 | B2 | 1/2004 | Azuma |
| 6,679,709 | B2 | 1/2004 | Takeuchi |
| 6,692,272 | B2 | 2/2004 | Lemke et al. |
| 6,695,627 | B2 | 2/2004 | Ortega et al. |
| 6,702,590 | B2 | 3/2004 | Zaderej et al. |
| 6,702,594 | B2 | 3/2004 | Lee et al. |
| 6,705,902 | B1 | 3/2004 | Yi et al. |
| 6,709,294 | B1 | 3/2004 | Cohen et al. |
| 6,712,621 | B2 | 3/2004 | Li et al. |
| 6,712,646 | B2 | 3/2004 | Shindo |
| 6,716,045 | B2 | 4/2004 | Meredith |
| 6,716,068 | B2 | 4/2004 | Wu |
| 6,717,825 | B2 | 4/2004 | Volstorf |
| 6,726,492 | B1 | 4/2004 | Yu |
| 6,736,664 | B2 | 5/2004 | Ueda et al. |
| 6,739,910 | B1 | 5/2004 | Wu |
| 6,740,820 | B2 | 5/2004 | Cheng |
| D492,295 | S | 6/2004 | Glatt |
| 6,743,037 | B2 | 6/2004 | Kassa et al. |
| 6,743,059 | B1 | 6/2004 | Korsunsky et al. |
| 6,746,278 | B2 * | 6/2004 | Nelson et al. ..... 439/607.07 |
| 6,749,439 | B1 | 6/2004 | Potter et al. |
| 6,762,067 | B1 | 7/2004 | Quinones et al. |
| 6,764,341 | B2 | 7/2004 | Lappoehn |
| 6,769,883 | B2 | 8/2004 | Brid et al. |
| 6,769,935 | B2 | 8/2004 | Stokoe et al. |
| 6,776,635 | B2 | 8/2004 | Blanchfield et al. |
| 6,776,649 | B2 | 8/2004 | Pape et al. |
| 6,780,027 | B2 | 8/2004 | Allison et al. |
| 6,786,771 | B2 | 9/2004 | Gailus |
| 6,790,088 | B2 | 9/2004 | Ono et al. |
| 6,796,831 | B1 | 9/2004 | Yasufuku et al. |
| 6,799,215 | B1 | 9/2004 | Giroir et al. |
| D497,343 | S | 10/2004 | Busse et al. |
| 6,805,278 | B1 | 10/2004 | Olson et al. |
| 6,808,399 | B2 | 10/2004 | Rothermel et al. |
| 6,808,420 | B2 | 10/2004 | Whiteman, Jr. et al. |
| 6,810,783 | B1 | 11/2004 | Larose |
| 6,811,440 | B1 | 11/2004 | Rothermel et al. |
| 6,814,590 | B2 | 11/2004 | Minich et al. |
| 6,814,619 | B1 | 11/2004 | Stokoe et al. |
| 6,824,391 | B2 | 11/2004 | Mickievicz et al. |
| 6,829,143 | B2 | 12/2004 | Russell et al. |
| 6,835,072 | B2 | 12/2004 | Simons et al. |
| 6,835,103 | B2 | 12/2004 | Middlehurst et al. |
| 6,843,686 | B2 | 1/2005 | Ohnishi et al. |
| 6,843,687 | B2 | 1/2005 | McGowan et al. |
| 6,848,886 | B2 | 2/2005 | Schmaling et al. |
| 6,848,944 | B2 | 2/2005 | Evans |
| 6,848,950 | B2 | 2/2005 | Allison et al. |
| 6,848,953 | B2 | 2/2005 | Schell et al. |
| 6,851,974 | B2 | 2/2005 | Doutrich |
| 6,851,980 | B2 | 2/2005 | Nelson et al. |
| 6,852,567 | B1 | 2/2005 | Lee et al. |
| D502,919 | S | 3/2005 | Studnicky, III |
| 6,866,549 | B2 | 3/2005 | Kimura et al. |
| 6,869,292 | B2 | 3/2005 | Johnescu et al. |
| 6,872,085 | B1 * | 3/2005 | Cohen et al. ..... 439/108 |
| 6,884,117 | B2 | 4/2005 | Korsunsky et al. |
| 6,890,214 | B2 | 5/2005 | Brown et al. |
| 6,890,221 | B2 | 5/2005 | Wagner |
| 6,893,272 | B2 | 5/2005 | Yu |
| 6,893,300 | B2 | 5/2005 | Zhou et al. |
| 6,893,686 | B2 | 5/2005 | Egan |
| 6,899,566 | B2 | 5/2005 | Kline et al. |
| 6,902,411 | B2 | 6/2005 | Kubo |
| 6,905,367 | B2 | 6/2005 | Crane, Jr. et al. |
| 6,913,490 | B2 | 7/2005 | Whiteman, Jr. et al. |
| 6,918,776 | B2 | 7/2005 | Spink, Jr. |
| 6,918,789 | B2 | 7/2005 | Lang et al. |
| 6,929,504 | B2 | 8/2005 | Ling et al. |
| 6,932,649 | B1 | 8/2005 | Rothermel et al. |
| 6,939,173 | B1 | 9/2005 | Elco et al. |
| 6,945,796 | B2 | 9/2005 | Bassler et al. |
| 6,947,012 | B2 | 9/2005 | Aisenbrey |
| 6,951,466 | B2 | 10/2005 | Sandoval et al. |
| 6,953,351 | B2 | 10/2005 | Fromm et al. |
| 6,969,268 | B2 | 11/2005 | Brunker |
| 6,969,280 | B2 | 11/2005 | Chien et al. |
| 6,975,511 | B1 | 12/2005 | Lebo et al. |
| 6,976,886 | B2 | 12/2005 | Winings et al. |
| 6,979,202 | B2 | 12/2005 | Benham et al. |
| 6,979,215 | B2 | 12/2005 | Avery et al. |
| 6,981,883 | B2 | 1/2006 | Raistrick et al. |
| 6,988,902 | B2 | 1/2006 | Winings et al. |

(56) References Cited

U.S. PATENT DOCUMENTS

| | | | |
|---|---|---|---|
| 6,994,569 | B2 | 2/2006 | Minich et al. |
| 7,001,189 | B1 | 2/2006 | McGowan et al. |
| 7,021,975 | B2 | 4/2006 | Lappohn |
| 7,040,901 | B2 | 5/2006 | Benham et al. |
| 7,044,794 | B2 | 5/2006 | Consoli et al. |
| 7,059,892 | B1 | 6/2006 | Trout |
| 7,059,919 | B2 | 6/2006 | Clark et al. |
| 7,065,871 | B2 | 6/2006 | Minich et al. |
| 7,070,464 | B2 | 7/2006 | Clark et al. |
| 7,074,096 | B2 | 7/2006 | Copper et al. |
| 7,086,147 | B2 | 8/2006 | Caletka et al. |
| 7,090,501 | B1 | 8/2006 | Scherer et al. |
| 7,094,102 | B2 | 8/2006 | Cohen et al. |
| 7,097,465 | B1 | 8/2006 | Korsunsky et al. |
| 7,097,506 | B2 | 8/2006 | Nakada |
| 7,101,191 | B2 | 9/2006 | Benham et al. |
| 7,101,228 | B2 | 9/2006 | Hamner et al. |
| 7,104,812 | B1 | 9/2006 | Bogiel et al. |
| 7,108,556 | B2 | 9/2006 | Cohen et al. |
| 7,114,963 | B2 | 10/2006 | Shuey et al. |
| 7,114,964 | B2 | 10/2006 | Winings et al. |
| 7,118,391 | B2 | 10/2006 | Minich et al. |
| RE39,380 | E | 11/2006 | Davis |
| 7,131,870 | B2 | 11/2006 | Whiteman, Jr. et al. |
| 7,137,848 | B1 | 11/2006 | Trout et al. |
| 7,153,162 | B2 | 12/2006 | Mizumura et al. |
| 7,160,151 | B1 | 1/2007 | Rigby et al. |
| 7,163,421 | B1 | 1/2007 | Cohen et al. |
| 7,168,963 | B2 | 1/2007 | Minich et al. |
| 7,172,461 | B2 | 2/2007 | Davis et al. |
| 7,182,642 | B2 | 2/2007 | Ngo et al. |
| 7,182,643 | B2 | 2/2007 | Winings et al. |
| D540,258 | S | 4/2007 | Peng et al. |
| 7,204,699 | B2 | 4/2007 | Stoner |
| 7,207,807 | B2 | 4/2007 | Fogg |
| D541,748 | S | 5/2007 | Peng et al |
| D542,736 | S | 5/2007 | Riku |
| 7,220,141 | B2 | 5/2007 | Daily et al. |
| 7,239,526 | B1 | 7/2007 | Bibee |
| 7,241,168 | B2 | 7/2007 | Sakurai et al. |
| 7,258,562 | B2 | 8/2007 | Daily et al. |
| D550,158 | S | 9/2007 | Victor |
| D550,628 | S | 9/2007 | Whiteman, Jr. et al. |
| 7,267,515 | B2 | 9/2007 | Lappohn |
| 7,270,574 | B1 | 9/2007 | Ngo |
| 7,273,382 | B2 | 9/2007 | Igarashi et al. |
| 7,278,856 | B2 | 10/2007 | Minich |
| 7,281,950 | B2 | 10/2007 | Belopolsky |
| D554,591 | S | 11/2007 | Victor |
| 7,292,055 | B2 | 11/2007 | Egitto |
| 7,303,427 | B2 | 12/2007 | Swain |
| 7,309,239 | B2 | 12/2007 | Shuey et al. |
| 7,316,585 | B2 | 1/2008 | Smith et al. |
| 7,322,855 | B2 | 1/2008 | Mongold et al. |
| 7,331,802 | B2 | 2/2008 | Rothermel et al. |
| 7,335,043 | B2 | 2/2008 | Hgo et al. |
| 7,338,321 | B2 | 3/2008 | Laurx |
| 7,347,740 | B2 | 3/2008 | Minich |
| 7,351,071 | B2 | 4/2008 | Korsunsky et al. |
| 7,381,092 | B2 | 6/2008 | Nakada |
| 7,384,289 | B2 | 6/2008 | Minich |
| 7,384,311 | B2 | 6/2008 | Sharf et al. |
| 7,402,064 | B2 | 7/2008 | Daily |
| 7,407,387 | B2 | 8/2008 | Johnescu |
| 7,422,483 | B2 | 9/2008 | Avery et al. |
| 7,425,145 | B2 | 9/2008 | Ngo et al. |
| 7,429,176 | B2 | 9/2008 | Johnescu |
| 7,445,457 | B1 | 11/2008 | Frangioso, Jr. et al. |
| 7,452,242 | B2 | 11/2008 | Poh et al. |
| 7,452,249 | B2 | 11/2008 | Daily |
| 7,458,839 | B2 | 12/2008 | Ngo |
| 7,467,955 | B2 | 12/2008 | Raistrick et al. |
| 7,476,108 | B2 | 1/2009 | Swain |
| 7,497,735 | B2 | 3/2009 | Belopolsky |
| 7,497,736 | B2 | 3/2009 | Minich et al. |
| 7,500,871 | B2 | 3/2009 | Minich et al. |
| 7,503,804 | B2 | 3/2009 | Minich |
| 7,541,135 | B2 | 6/2009 | Swain |
| 7,549,897 | B2 | 6/2009 | Fedder et al. |
| 7,553,182 | B2 | 6/2009 | Buck et al. |
| 7,588,463 | B2 | 9/2009 | Yamada et al. |
| 7,621,781 | B2 | 11/2009 | Rothermel et al. |
| D607,822 | S | 1/2010 | Dennes |
| D611,908 | S | 3/2010 | Takada et al. |
| 7,708,569 | B2 | 5/2010 | Sercu et al. |
| D618,180 | S | 6/2010 | Gross et al. |
| D618,181 | S | 6/2010 | Gross et al. |
| 7,753,731 | B2 | 7/2010 | Cohen et al. |
| 7,762,843 | B2 | 7/2010 | Minich et al. |
| D626,075 | S | 10/2010 | Truskett et al. |
| 7,833,065 | B2 | 11/2010 | Lin et al. |
| D628,963 | S | 12/2010 | Sau et al. |
| 7,883,366 | B2 | 2/2011 | Davis et al. |
| 7,976,326 | B2 | 7/2011 | Stoner |
| 7,988,456 | B2 | 8/2011 | Davis et al. |
| 8,011,957 | B2 | 9/2011 | Pan |
| D651,177 | S | 12/2011 | Luo |
| 8,079,847 | B2 | 12/2011 | Davis et al. |
| D653,621 | S | 2/2012 | Gross et al. |
| 8,109,770 | B2 | 2/2012 | Perugini et al. |
| 8,157,599 | B2 | 4/2012 | Wei |
| 8,231,415 | B2 | 7/2012 | Johnescu et al. |
| 8,277,241 | B2 | 10/2012 | Horchler et al. |
| 8,366,485 | B2 | 2/2013 | Johnescu |
| 8,408,939 | B2 | 4/2013 | Davis et al. |
| 8,414,199 | B2 | 4/2013 | Ishigami |
| 8,465,213 | B2 | 6/2013 | Tamura et al. |
| 8,480,413 | B2 | 7/2013 | Minich et al. |
| RE44,556 | E | 10/2013 | Minich |
| 2001/0003685 | A1 | 6/2001 | Aritani |
| 2001/0008189 | A1 | 7/2001 | Reede |
| 2001/0012729 | A1 | 8/2001 | Van Woensel |
| 2001/0041477 | A1 | 11/2001 | Billman et al. |
| 2001/0046810 | A1 | 11/2001 | Cohen et al. |
| 2001/0046816 | A1 | 11/2001 | Saito et al. |
| 2002/0013101 | A1 | 1/2002 | Long |
| 2002/0039857 | A1 | 4/2002 | Naito et al. |
| 2002/0084105 | A1 | 7/2002 | Geng et al. |
| 2002/0098727 | A1 | 7/2002 | McNamara et al. |
| 2002/0106930 | A1 | 8/2002 | Pape et al. |
| 2002/0106932 | A1 | 8/2002 | Holland et al. |
| 2002/0111068 | A1 | 8/2002 | Cohen et al. |
| 2002/0127903 | A1 | 9/2002 | Billman et al. |
| 2002/0142629 | A1 | 10/2002 | Zaderej et al. |
| 2002/0142676 | A1 | 10/2002 | Hosaka et al. |
| 2002/0159235 | A1 | 10/2002 | Miller et al. |
| 2002/0173177 | A1 | 11/2002 | Korunsky et al. |
| 2002/0187688 | A1 | 12/2002 | Marvin et al. |
| 2002/0193019 | A1 | 12/2002 | Blanchfield et al. |
| 2003/0116857 | A1 | 6/2003 | Taniguchi et al. |
| 2003/0119378 | A1 | 6/2003 | Avery |
| 2003/0143894 | A1 | 7/2003 | Kline et al. |
| 2003/0171010 | A1 | 9/2003 | Winings et al. |
| 2003/0203665 | A1 | 10/2003 | Ohnishi et al. |
| 2003/0219999 | A1 | 11/2003 | Minich et al. |
| 2003/0220021 | A1 | 11/2003 | Whiteman, Jr. et al. |
| 2003/0236035 | A1 | 12/2003 | Kuroda et al. |
| 2004/0018757 | A1 | 1/2004 | Lang et al. |
| 2004/0038590 | A1 | 2/2004 | Lang et al. |
| 2004/0072470 | A1 | 4/2004 | Lang et al. |
| 2004/0077224 | A1 | 4/2004 | Marchese |
| 2004/0087196 | A1 | 5/2004 | Lang et al. |
| 2004/0114866 | A1 | 6/2004 | Hiramatsu |
| 2004/0157477 | A1 | 8/2004 | Johnson et al. |
| 2004/0224559 | A1 | 11/2004 | Nelson et al. |
| 2004/0235321 | A1 | 11/2004 | Mizumura et al. |
| 2004/0259420 | A1 | 12/2004 | Wu |
| 2005/0009402 | A1 | 1/2005 | Chien et al. |
| 2005/0026503 | A1 | 2/2005 | Trout et al. |
| 2005/0032401 | A1 | 2/2005 | Kobayashi |
| 2005/0048838 | A1 | 3/2005 | Korsunsky et al. |
| 2005/0079763 | A1 | 4/2005 | Lemke et al. |
| 2005/0101166 | A1 | 5/2005 | Kameyama |
| 2005/0101188 | A1 | 5/2005 | Benham et al. |

(56) References Cited

U.S. PATENT DOCUMENTS

| | | | |
|---|---|---|---|
| 2005/0112952 | A1 | 5/2005 | Wang et al. |
| 2005/0118869 | A1 | 6/2005 | Evans |
| 2005/0170700 | A1 | 8/2005 | Shuey et al. |
| 2005/0196987 | A1 | 9/2005 | Shuey et al. |
| 2005/0202722 | A1 | 9/2005 | Regnier et al. |
| 2005/0215121 | A1 | 9/2005 | Tokunaga |
| 2005/0227552 | A1 | 10/2005 | Yamashita et al. |
| 2005/0277315 | A1 | 12/2005 | Mongold et al. |
| 2005/0287869 | A1 | 12/2005 | Kenny et al. |
| 2006/0003620 | A1 | 1/2006 | Daily et al. |
| 2006/0014433 | A1 | 1/2006 | Consoli et al. |
| 2006/0024983 | A1 | 2/2006 | Cohen et al. |
| 2006/0024984 | A1 | 2/2006 | Cohen et al. |
| 2006/0046526 | A1 | 3/2006 | Minich |
| 2006/0051987 | A1 | 3/2006 | Goodman et al. |
| 2006/0068610 | A1 | 3/2006 | Belopolsky |
| 2006/0068641 | A1 | 3/2006 | Hull et al. |
| 2006/0073709 | A1 | 4/2006 | Reid |
| 2006/0116857 | A1 | 6/2006 | Sevic et al. |
| 2006/0121749 | A1 | 6/2006 | Fogg |
| 2006/0128197 | A1 | 6/2006 | McGowan et al. |
| 2006/0141818 | A1 | 6/2006 | Ngo |
| 2006/0183377 | A1 | 8/2006 | Sinsheimer |
| 2006/0192274 | A1 | 8/2006 | Lee et al. |
| 2006/0216969 | A1 | 9/2006 | Bright et al. |
| 2006/0228912 | A1 | 10/2006 | Morlion et al. |
| 2006/0232301 | A1 | 10/2006 | Morlion et al. |
| 2006/0281354 | A1 | 12/2006 | Ngo et al. |
| 2007/0004287 | A1 | 1/2007 | Marshall |
| 2007/0021002 | A1 | 1/2007 | Laurx et al. |
| 2007/0042639 | A1 | 2/2007 | Manter et al. |
| 2007/0071391 | A1 | 3/2007 | Mazotti et al. |
| 2007/0099455 | A1 | 5/2007 | Rothermel et al. |
| 2007/0099512 | A1 | 5/2007 | Sato |
| 2007/0183707 | A1 | 8/2007 | Umezawa |
| 2007/0183724 | A1 | 8/2007 | Sato |
| 2007/0202715 | A1 | 8/2007 | Daily et al. |
| 2007/0202747 | A1 | 8/2007 | Sharf et al. |
| 2007/0205774 | A1 | 9/2007 | Minich |
| 2007/0207641 | A1 | 9/2007 | Minich |
| 2007/0293084 | A1 | 12/2007 | Ngo |
| 2008/0032524 | A1 | 2/2008 | Lemke et al. |
| 2008/0045079 | A1 | 2/2008 | Minich et al. |
| 2008/0176453 | A1 | 7/2008 | Minich et al. |
| 2008/0232737 | A1 | 9/2008 | Ishigami et al. |
| 2008/0246555 | A1 | 10/2008 | Kirk et al. |
| 2008/0248670 | A1 | 10/2008 | Daily et al. |
| 2008/0316729 | A1 | 12/2008 | Rothermel et al. |
| 2009/0011643 | A1 | 1/2009 | Amleshi et al. |
| 2010/0055983 | A1 | 3/2010 | Wu |
| 2010/0093209 | A1 | 4/2010 | Liu et al. |
| 2010/0216342 | A1 | 8/2010 | Lin |
| 2010/0240233 | A1 | 9/2010 | Johnescu et al. |
| 2010/0291803 | A1 | 11/2010 | Kirk |
| 2011/0159744 | A1 | 6/2011 | Buck |
| 2011/0195593 | A1 | 8/2011 | McGrath et al. |
| 2012/0214343 | A1 | 8/2012 | Buck et al. |
| 2012/0289095 | A1 | 11/2012 | Kirk |
| 2013/0005160 | A1 | 1/2013 | Minich |
| 2013/0122744 | A1 | 5/2013 | Morgan et al. |
| 2013/0149890 | A1 | 6/2013 | Schroll et al. |
| 2013/0195408 | A1 | 8/2013 | Hermeline et al. |
| 2013/0210246 | A1 | 8/2013 | Davis et al. |
| 2013/0273781 | A1 | 10/2013 | Buck et al. |
| 2014/0017957 | A1 | 1/2014 | Horchler et al. |

FOREIGN PATENT DOCUMENTS

| | | |
|---|---|---|
| DE | 3605316 | 8/1987 |
| DE | 4040551 | 6/1991 |
| DE | 10226279 | 11/2003 |
| DE | 102010005001 | 8/2010 |
| EP | 0212764 | 3/1987 |
| EP | 0273683 | 7/1988 |
| EP | 0337634 | 10/1989 |
| EP | 0442785 | 8/1991 |
| EP | 0486298 | 5/1992 |
| EP | 0321257 | 4/1993 |
| EP | 0560550 | 9/1993 |
| EP | 0562691 | 9/1993 |
| EP | 0591772 | 4/1994 |
| EP | 0623248 | 11/1995 |
| EP | 0706240 | 4/1996 |
| EP | 0782220 | 7/1997 |
| EP | 0789422 | 8/1997 |
| EP | 0843383 | 5/1998 |
| EP | 0635910 | 6/2000 |
| EP | 1024556 | 8/2000 |
| EP | 1111730 | 6/2001 |
| EP | 0891016 | 10/2002 |
| EP | 1091449 | 9/2004 |
| EP | 1148587 | 4/2005 |
| GB | 1162705 | 8/1969 |
| JP | 57/058115 | 4/1982 |
| JP | 60/072663 | 4/1985 |
| JP | 02/278893 | 11/1990 |
| JP | 0521119 | 1/1993 |
| JP | 05344728 | 12/1993 |
| JP | 0668943 | 3/1994 |
| JP | 6236788 | 8/1994 |
| JP | 7114958 | 5/1995 |
| JP | 07169523 | 7/1995 |
| JP | 0896918 | 4/1996 |
| JP | 08125379 | 5/1996 |
| JP | 09199215 | 7/1997 |
| JP | 11185886 | 7/1999 |
| JP | 2000/003743 | 1/2000 |
| JP | 2000/003744 | 1/2000 |
| JP | 2000/003745 | 1/2000 |
| JP | 2000/003746 | 1/2000 |
| JP | 2000/228243 | 8/2000 |
| JP | 2001/135388 | 5/2001 |
| JP | 2001/305182 | 10/2001 |
| JP | 2002/008790 | 1/2002 |
| JP | 2003/217785 | 7/2003 |
| JP | 2007/128706 | 5/2007 |
| KR | 100517561 | 9/2005 |
| TW | 576555 | 8/1990 |
| TW | 546872 | 8/2003 |
| WO | WO 90/16093 | 12/1990 |
| WO | WO 96/38889 | 12/1996 |
| WO | WO 96/42123 | 12/1996 |
| WO | WO 97/20454 | 6/1997 |
| WO | WO 97/43885 | 11/1997 |
| WO | WO 97/44859 | 11/1997 |
| WO | WO 97/45896 | 12/1997 |
| WO | WO 98/15989 | 4/1998 |
| WO | WO 00/16445 | 3/2000 |
| WO | WO 01/29931 | 4/2001 |
| WO | WO 01/39332 | 5/2001 |
| WO | WO 02/058191 | 7/2002 |
| WO | WO 02/101882 | 12/2002 |
| WO | WO 02/103847 | 12/2002 |
| WO | WO 2005/065254 | 7/2005 |
| WO | WO 2006/031296 | 3/2006 |
| WO | WO 2006/105535 | 10/2006 |
| WO | WO 2007/064632 | 6/2007 |
| WO | WO 2008/082548 | 7/2008 |
| WO | WO 2008/117180 | 10/2008 |
| WO | WO 2012/047619 | 4/2012 |
| WO | WO 2012/174120 | 12/2012 |

OTHER PUBLICATIONS

U.S. Appl. No. 13/832,096, filed Mar. 15, 2013, Stoner et al.

"1.0 HDMI Right Angle Header Assembly (19 Pin) Lead Free", Molex Incorporated, Jul. 20, 2004, 7 pages.

"1.90 by 1.35mm (.075 by.053) Pitch Impact, Backplane Connector System 3 and 4 Pair, Features and Specification", Molex, www.molex.com/link/Impact.html, 2008, 5 pages.

"4.0 UHD Connector Differential Signal Crosstalk, Reflections", 1998, p. 8-9.

(56) References Cited

OTHER PUBLICATIONS

"AMP Z-Dok and Z-Dok and Connectors", Tyco Electronics/AMP, Application Specification #114-13068, Aug. 30, 2005, 17 pages.
"AMP Z-Pack 2mm HM Connector, 2mm Centerline, Eight-Row, Right-Angle Applications", Electrical Performance Report, EPR 889065, Issued Sep. 1998, 59 pages.
"AMP Z-Pack 2mm HM Interconnection System", 1992/994, AMP Incorporated, 6 pages.
"AMP Z-Pack HM-Zd Performance at Gigabit Speeds", Tyco Electronics, Report #20GC014, Rev.B., May 4, 2001, 32 pages.
"B.? Bandwidth and Rise Time Budgets, Module 1-8 Fiber Optic Telecommunications (E-XVI-2a)", http:—cord.org-step_online-st1-8-st18exvi2a.htm, 2006, 1-3.
"Backplane Connectors", http://www.amphenol-tcs.com/products/connectors/backplane/index.html, Amphenol TCS (ATCS), Jun. 19, 2008, 1-3.
"Champ Z-Dok Connector System", Tyco Electronics, Jan. 2002, 3 pages.
"Daughtercard Hole Pattern: Signal Modules (10 & 25 positions) Connector Assembly", Customer No. C-163-5101-500, Teradyne Connection Systems, Inc., 2001, 1 page.
Derman, "Speed, Density Push Design Xomplexities", Electronic Engineering Times, May 1998, 2 pages.
"FCI's Airmax VS Connector System Honored at DesignCon 2005", http:—www.heilind.com-products-fci-airmax-vs-desidn.asp, Heilind Electronics, Inc., 2005, 1 page.
"Framatome Connector Specification", May 10, 1999, 1 page.
Fusi et al., "Differential Signal Transmission through Backplanes and Connectors", Electronic Packaging and Production, Mar. 1996, 27-31.
"GbXI-Trac Backplane Connector System", www.molex.com/cgi-bin, Molex, 2007, 1-3.
"Gig-Array Connector System, Board to Board Connectors", 2005, 4 pages.
"Gig-Array High Speed Mezzanine Connectors 15-40 mm Board to Board", FCI Corporation, Jun. 5, 2006, 1 page.
Goel et al., "AMP Z-Pack Interconnect System", AMP Incorporated, 1990, 9 pages.
"HDM, HDM Plus Connectors", http:—www.teradyne.com-prods-tcs-products-connectors-backplane-hdm-index.html, Amphenol TCS, 2006, 1 page.
"HDM/HDM Plus, 2mm, Backplane Interconnection System", Teradyne Connection Systems, 1993, 22 pages.
"HDM Separable Interface Detail", Molex, Feb. 17, 1993, 3 pages.
"HDM Stacker Signal Integrity", http://www.teradyne.com/prods/tcs/products/connectors/mezzanine/hdm_stacker/sidnintegrity.html, Amphenol TCS (ATCS), Feb. 2, 2006, 3 pages.
"High Definition Multimedia Interface (HDMI)", www.molex.com, Molex, Jun. 19, 2008, 2 pages.
"High Speed Backplane Interconnect Solutions", Tyco Electronics, 2007, 6 pages.
"High Speed Characterization Report, SEAM-30-02.0-S-10-2", www.samtec.com, SAMTEC, 2005, 55 pages.
"Honda High-Speed Backplane Connector NSP Series", Honda Connectors, Feb. 7, 2003, 25 pages.
Hult, "FCI's Problem Solving Approach Changes Market, The FCI Electronics AirMax VS", http:—www.connecotrsupplier.com-tech_updates_FCI-Airmax_archive.htm, ConnectorSupplier.com, 2006, 1-4.
Hunsaker, "Ventura Application Design", TB-2127, Amphenol, Aug. 25, 2005, 13 pages.
"Impact 3 Pair 10 Column Signal Module", Tyco Electronics, Mar. 25, 2008, 1 page.
"Impact, 3 Pair Header Unguided Open Assembly", Tyco Electronics, Apr. 11, 2008, 1 page.
"Impact Connector Offered by Tyco Electronic, High Speed Backplane Connector System", Tyco Electronics, Apr. 15, 2008, 12 pages.
"Lucent Technologies' Bell Labs and FCI Demonstrate 25gb-S Data Transmission Over Electrical Backplane Connectors", http:—www.lucent.com-press-0205-050201.bla.html, Lucent Tech Bell Labs, Feb. 1, 2005,1-4.
"Metral 2mm High-Speed Connectors, 1000, 2000, 3000 Series, Electrical Performance Data for Differential Applications", FCI Framatome Group, 2 pages.
"Metral Speed & Density Extensions", FCI, Jun. 3, 1999, 1-25.
"Mezzanine High Speed High-Density Connectors Gig-Array and Meg-Array Electrical Performance Data", FCI Corporation, 10 pages.
"MILLIPACS Connector, Type A Specification", Dec. 14, 2004, 1 page.
Nadolny et al., "Optimizing Connector Selection for Gigabit Signal Speeds", http:—www.ecnmag.com-article-CA45245, ECN, Sep. 1, 2000, 6 pages.
"NSP Series, Backplane High-Speed Data Transmission Cable Connectors", http:—www.honda-connectors.co.jp, Honda Connectors, 2006, 6 pages, English Translation attached.
"Open Pin Field Array Seaf Series", www.samtec.com, SAMTEC, 2005, 1 page.
"Overview for High Density Backplane Connector (Z-Pack TinMan)", Tyco Electronics, 2008, 1 page.
"Overview for High Density Backplane Connectors (Impact) Offered by Tyco Elecctronics", www.tycoelectronics.com/catalog, Tyco Electronics, 2007, 1-2.
"Overview: Backplane Products", http:—www.molex.com-cgi-bin-bv-molex-super_family-super_family.jsp?BV_SessionID=@, Molex, 2008, 1-3.
"PCB-Mounted Receptacle Assemblies, 2.00 mm (0.079 In) Centerlines, Right-Angle Solder-to-Board Signal Receptacle", Metral!, Berg Electronics, 2 pages.
Siemens, "SpeedPac: A New Concept For the Next Generation of Transmission Speed," Backplane Interconnection, Jan. 1996.
Straus, "Shielded In-Line Electrical Multiconnector", IBM Technical Disclosure Bulletin, Aug. 3, 1967, 10(3), 3 pages.
"Two-Piece, High-Speed Connectors", www.tycoelectronics.com/catalog, Tyco Electronics, 2007, 1-3.
"Tyco Unveils Z-Pack TinMan Orthogonal Connector System", http://www.epn-online.com/page/new59327/tyco-unveils-z-pack-orthogonal-conn, Oct. 13, 2009, 4 pages.
"Ventura High Performance, Highest Density Available", http://www.amphenol-tcs.com/products/connectors/backplane/ventura/index.html, Amphenol TCS (ATCS), Jun. 19, 2008, 1-2.
"VHDM Connector", http://www.teradyne.com/prods/tcs/products/connectors/backplane/vhdm/index.html, Amphenol TCS (ATCS), Jan. 31, 2006, 2 pages.
"VHDM Daughterboard Connectors Feature Press-Fit Terminations and a Non-Stubbing Separable Interface", Teradyne, Inc. Connections Sys Div, Oct. 8, 1997, 46 pages.
"VHDM High-Speed Differential (VHDM HSD)", http://www.teradyne.com/prods/bps/vhdm/hsd.html, Teradyne, Jan. 24, 2000, 6 pages.
"VHDM L-Series Connector", http://www.teradyne.com/prods/tcs/products/connectors/backplane/vhdm_1-series/index.html, Amphenol TCS(ATCS), 2006, 4 pages.
"XCede® Connector", http://www.amphenol-tcs.com/products/connectors/backplane/xcede/index.html, Amphenol TCS (ATCS), Jun. 19, 2008, 1-5.
"Z-Dok and Connector", http://2dok.tyco.electronics.com, Tyco Electronics, May 23, 2003, 1-15.
"Z-Pack Slim UHD", http:/ww.zpackuhd.com, Tyco Electronics, 2007, 8 pages.
"Z-Pack TinMan Product Portfolio Expanded to Include 6-Pair Module", Tyco Electronics, Jun. 19, 2008, 1 page.
"Z-Pack TinMan High Speed Orthogonal Connector Product Feature Selector", Tyco Electronics, 2009, 2 pages.
U.S. Appl. No. 29/418,299, filed Apr. 13, 2012, Buck et al.
U.S. Appl. No. 29/418,310, filed Apr. 13, 2012, Buck et al.
U.S. Appl. No. 29/418,313, filed Apr. 13, 2012, Zerebilov et al.
U.S. Appl. No. 29/426,921, filed Jul. 11, 2012, Horchler.
U.S. Appl. No. 29/444,125, filed Jan. 25, 2013, Harper, Jr. et al.
U.S. Appl. No. 29/449,794, filed Mar. 15, 2013, Zerebilov et al.

(56) References Cited

OTHER PUBLICATIONS

Ahn et al., "A Design of the Low-Pass Filter Using the Novel Microstrip Defected Ground Structure", IEEE Transactions on Microwave Theory and Techniques, 2001, 49(1), 86-93.
Berg Electronics Catalog, p. 13-96, Solder Washers, 1996, 1 page.
Chen et al., "Characteristics of Coplanar Transmission Lines on Multilayer Substrates: Modeling and Experiments", IEEE Transactions on Microwave Theory and Techniques, Jun. 1997, 45(6), 939-945.
Cheng et al., "Terahertz-Bandwidth Characteristics of Coplanar Transmission Lines on Low Permittivity Substrates", IEEE Transactions on Microwave Theory and Techniques, 1994, 42(12), 2399-2406.
Chua et al., "'Broadband Characterisation of CPW Transition and Transmission Line Parameters for Small Reflection Up to 100 GHZ", RF and Microwave Conference, 2004, 269-271.
European Patent Application No. 12305119.5: European Search Report dated Jul. 11, 2012, 5 pages.
Finan, "Thermally Conductive Thermoplastics", LNP Engineering Plastics, Inc., Plastics Engineering 2000, www.4spe.org, 4 pages.
Hettak et al., "Simultaneous Realization of Millimeter Wave Uniplanar Shunt Stubs and DC Block", IEEE MTT-S Digest, 1998, 809-812.
IBM Technical Disclosure Bulletin, 1972, 14(8), 2 pages.
IBM Technical Disclosure Bulletin, 1977, 20(2), 2 pages.
IBM Technical Disclosure Bulletin, 1990, 32(11), 2 pages.
International Application No. PCT/US2003/014370, International Search Report dated Aug. 6, 2003, 2 pages.
International Application No. PCT/US2010/040899, International Search Report dated Jan. 25, 2011, 2 pages.
International Patent Application No. PCT/US2013/035775: International Search Report dated Jul. 18, 2013, 3 pages.
International Patent Application No. PCT/US2013/035915: International Search Report and Written Opinion dated Jul. 25, 2013, 17 pages.
International Patent Application No. PCT/US2013/049995: International Search Report dated Oct. 28, 2013, 18 pages.
Kazmierowicz, "Profiling Your Solder Reflow Oven in Three Passes or Less", KIC Oven Profiling, Surface Mount Technology, 1990, 2 pages.
Kazmierowicz, "The Science Behind Conveyor Oven Thermal Profiling", KIC Oven Profiling, Surface Mount Technology, 1990, 9 pages.
Lee et al., "Characteristic of the Coplanar Waveguide to Microstrip Right-Angled Transition", Department of Electronics Engineering, 1998, 3 pages.
Leung et al., "Low-Loss Coplanar Waveguides Interconnects on Low-Resistivity Silicon Substrate", IEEE Transactions on Components and Packaging Technologies, 2004, 27(3), 507-512.
Lim et al., "A Spiral-Shaped Defected Ground Structure for Coplanar Waveguide", IEEE Microwave and Wireless Components Letters, 2002, 12(9), 330-332.
Machac et al., "Space Leakage of Power from Uniplanar Transmission Lines", Czech Technical University, 565-568.
Mao et al., "Characterization of Coplanar Waveguide Open End Capacitance-Theory and Experiment", IEEE Transactions on Microwave Theory and Techniques, 1994, 42(6), 1016-1024.
"Metral 1000 Series, 5 Row Receptacle, Right Angle, Press Fit, PCB Mounted Receptacle Assembly", FCI 2001, 1 page.
"Micro Electronic Interconnects", Alphametals, 1990, 4 pages.
Mottonen et al., "Novel Wide-Band Coplanar Waveguide-to-Rectangular Waveguide Transition", IEEE Transactions on Microwave Theory and Techniques, 2004, 52(8), 1836-1842.
Ogando, "And now-An Injection-Molded Heat Exchanger", Sure, plastics are thermal insulators, but additive packages allow them to conduct heat instead, Global Design News, Nov. 1, 2000, 4 pages.
Power TwinBlade I/O Cable Connector RA-North-South, No. GS-20_072, Aug. 6, 2007, 11 pages.
"Product Datasheets, 10 Bgit/s XENPAK 850 nm Transponder", MergeOptics GmbH, 2005, 13 pages.
"Product Datasheets, Welcome to XENPAK.org.", http://www.xenpak.org., 2001, 1 page.
Research Disclosure, Kenneth Mason Publications Ltd., England, Aug. 1990, No. 316, 1 page.
Research Disclosure, Kenneth Mason Publications Ltd., England, Oct. 1992, No. 342, 1 page.
Sherman, "Plastics that Conduct Heat", Plastics Technology Online, Jun. 2001, http://www.plasticstechnology.com, 4 pages.
Soliman. et al., "Multimodel Characterization ofPlanar Microwave Structures", IEEE Transactions on Microwave Theory and Techniques, 2004, 52(1), 175-182.
Son et al., "Picosecond Pulse Propagation on Coplanar Striplines Fabricated on Lossy Semiconductor Substrates: Modeling and Experiments", IEEE Transactions on Microwave Theory and Techniques, 1993, 41(9), 1574-1580.
Suh et al., "Coplanar Strip line Resonators Modeling and Applications to Filters", IEEE Transactions on Microwave Theory and Techniques, 2002, 50(5), 1289-1296.
Tzuang et al., "Leaky Mode Perspective on Printed Antenna", Proc. Natl. Sci. Counc. ROC(A), 1999, 23(4), 544-549.
Weller et al., "High Performance Microshield Line Components", IEEE Transactions on Microwave Theory and Techniques, 1995, 43(3), 534-543.
Williams et al., "Accurate Transmission Line Characterization", IEEE Microwave and Guided Wave Letters, 1993, 3(8), 247-249.
Wu et al., "'Full-Wave Characterization of the Mode Conversion in a Coplanar Waveguide Right-Angled Bend", IEEE Transactions on Microwave Theory and Techniques, 1995, 43(11), 2532-2538.
Ya et al., "Microstrip and Slotline Two-Pole Microwave Filters with Additional Transmission Zeros", Int. Crimean Conference, Microwave & Telecommunication Technology, 2004, 405-407 (English Abstract provided).

* cited by examiner

ELECTRICAL CONNECTOR HAVING RIBBED GROUND PLATE

CROSS-REFERENCE TO RELATED APPLICATIONS

This is a continuation application of U.S. patent application Ser. No. 12/722,797 filed Mar. 12, 2010, which claims priority to U.S. Patent Application Ser. No. 61/161,687 filed Mar. 19, 2009, the disclosure of each of which is hereby incorporated by reference as if set forth in its entirety herein.

BACKGROUND

Electrical connectors provide signal connections between electronic devices using electrically-conductive contacts. It is sometimes desirable to increase data transfer through an existing connector without changing the physical dimensions (height, width, depth, mating interface, and mounting interface) of the connector. However, it is difficult to change one aspect of an electrical connector without unintentionally changing another aspect. For example, metallic crosstalk shields can be added to an electrical connector to reduce crosstalk, but the addition of shields generally lowers the impedance. At lower data transmission speeds, such at 1 to 1.25 Gigabits/sec, impedance matching does not substantially affect performance. However, as data transmission speeds increase to 10 Gigabits/sec through 40 Gigabits/sec and any discrete point therebetween, skew and impedance mismatches become problematic. Therefore, while crosstalk can be lowered by adding a metallic crosstalk shield to an existing electrical connector, other problems with signal integrity can be created.

What is therefore desired is an electrical connector having a shield that avoids the shortcomings of conventional shields.

SUMMARY

In accordance with one aspect, an electrical connector includes a dielectric housing, a plurality of electrical signal contacts carried by the dielectric housing, and a ground plate carried by the dielectric housing. The electrical signal contacts are arranged along a first plane, wherein the signal contacts define signal pairs such that a respective gap is disposed between adjacent signal pairs. The ground plate includes a ground plate body oriented in a second plane that is substantially parallel to the first plane and offset from the first plane. The ground plate body defines first and second opposed surfaces. The ground plate includes at least one stamped or embossed rib that defines first and second opposed surfaces, wherein the first surface of the rib projects from the first surface of the ground plate body in a direction toward the gap, and the second surface is recessed into the second surface of the ground plate body. The at least one stamped or embossed rib takes the place of or electrically functions as a ground contact between two differential signal pairs positioned edge-to-edge with respect to one another or broadside-to-broadside with respect to one another.

BRIEF DESCRIPTION OF THE DRAWINGS

The foregoing summary, as well as the following detailed description of a preferred embodiment of the application, will be better understood when read in conjunction with the appended drawings. For the purposes of illustrating the flexible anchoring keel and related instruments of the present application, there is shown in the drawings a preferred embodiment. It should be understood, however, that the application is not limited to the precise arrangements and instrumentalities shown. In the drawings.

DETAILED DESCRIPTION

Figure 1:
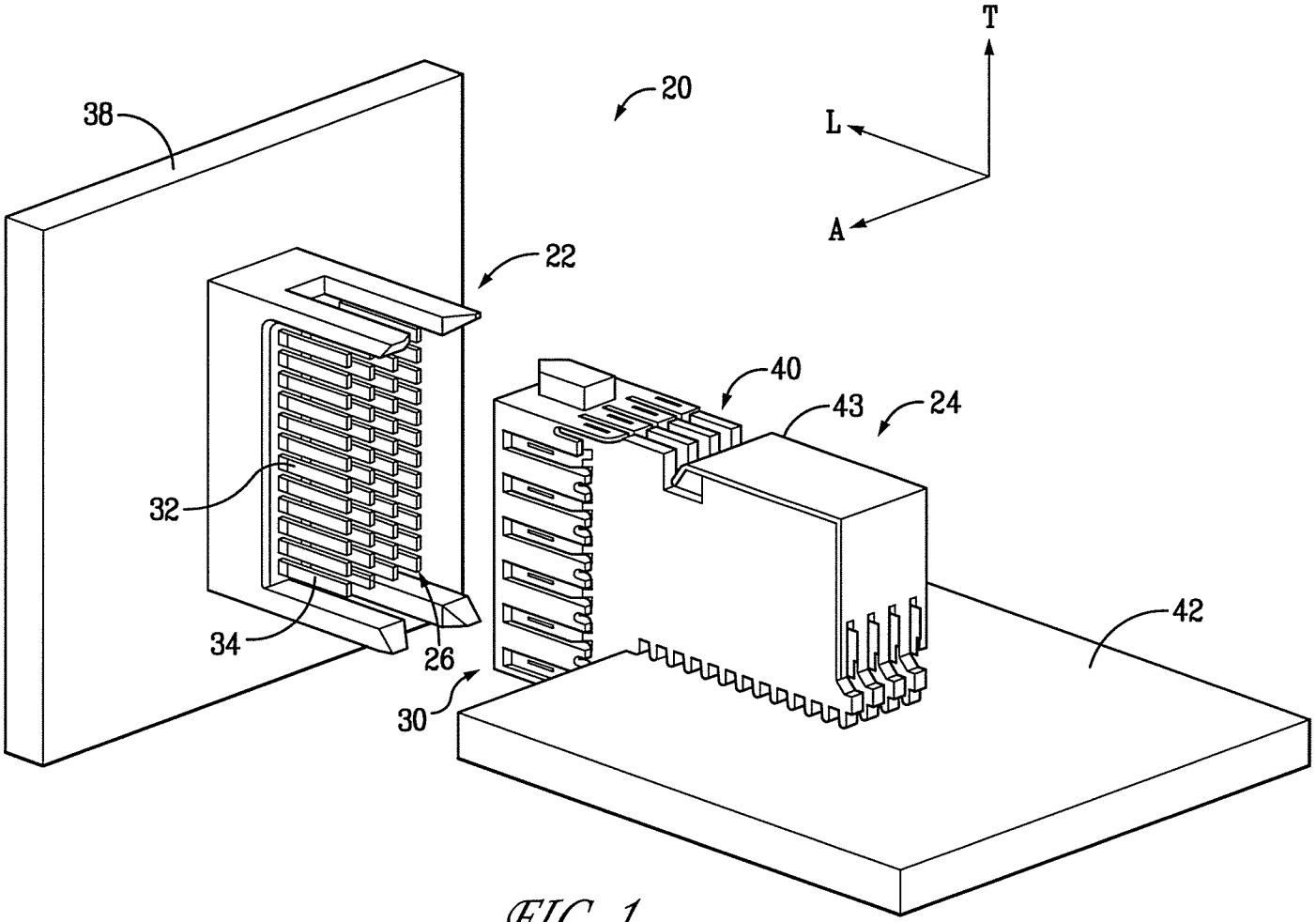
FIG. 1 is a perspective view of an electrical connector assembly including a vertical header connector and a right-angle receptacle connector mounted onto respective substrates, and configured to be mated with each other.
Figure 2A:
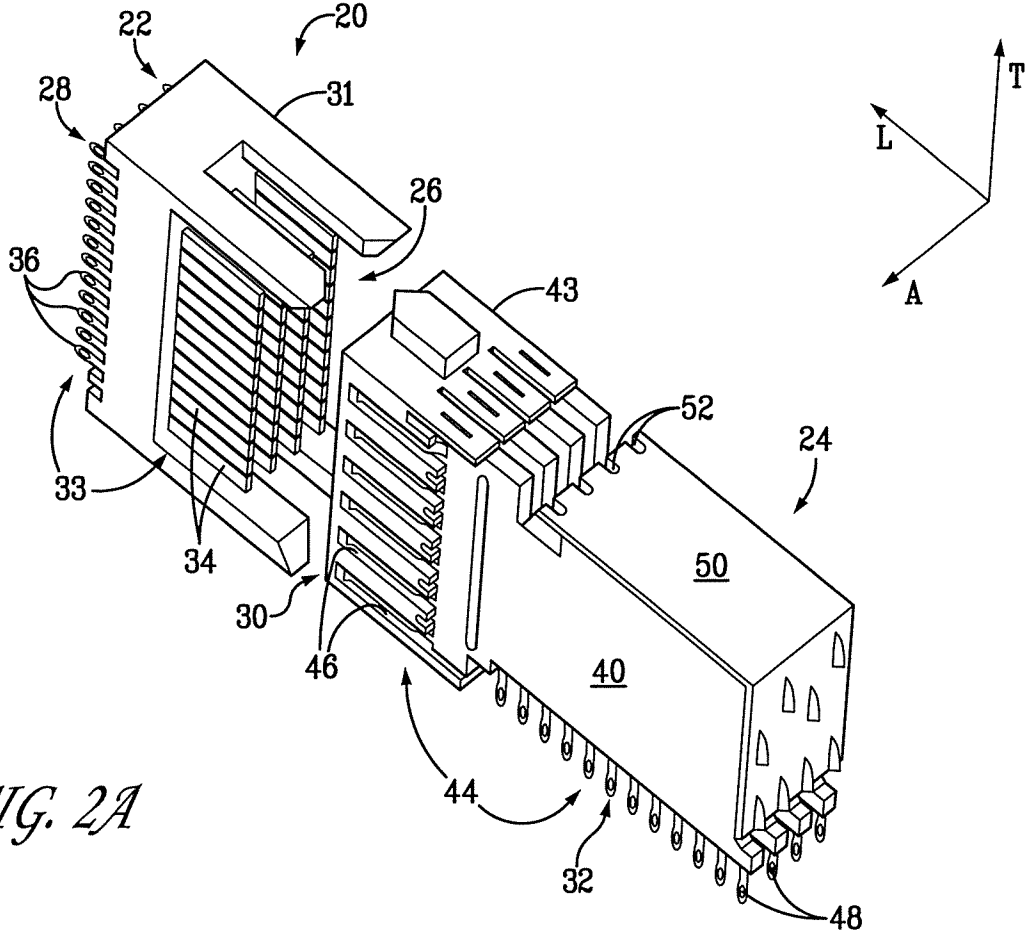
FIG. 2A is a perspective view of the electrical connector assembly similar to FIG. 1, but without the substrates.
Figure 2B:
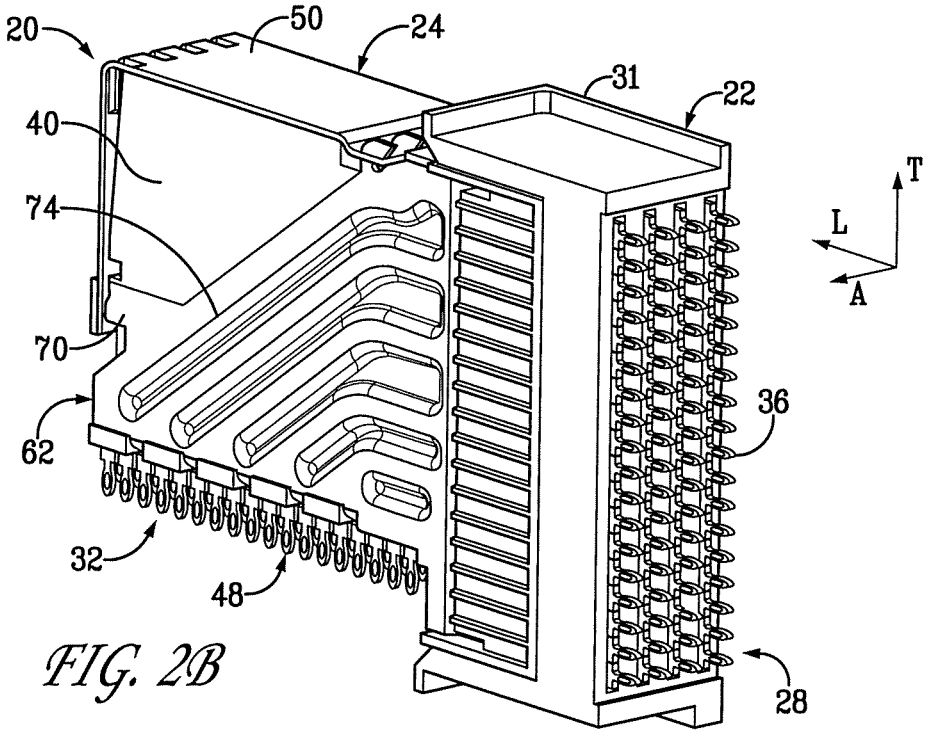
FIG. 2B is another perspective view of the electrical connector assembly as illustrated in FIG. 2A, but showing the electrical connectors in a mated configuration.

Referring initially to FIGS. 1-2B, an electrical connector assembly 20 includes a first electrical connector 22 and a second electrical connector 24 configured to mate with each other so as to establish an electrical connection between complementary substrates 38 and 42. As shown, the first electrical connector 22 can be a vertical connector defining a mating interface 26 and a mounting interface 28 that extends substantially parallel to the mating interface 26. The second electrical connector 24 can be a right-angle connector defining a mating interface 30 and a mounting interface 32 that extends substantially perpendicular to the mating interface 30.

The first electrical connector 22 includes a housing 31 that carries a plurality of electrical contacts 33. The electrical contacts 33 may be insert molded prior to attachment to the housing 31 or stitched into the housing 31. The electrical contacts 33 define respective mating ends 34 that extend along the mating interface 26, and mounting ends 36 that extend along the mounting interface 28. Each of the mating ends 34 can define a respective first broadside and a respective second broadside opposite the first broadside so as to define header mating ends. Thus, the first electrical connector 22 can be referred to as a header connector as illustrated. The mounting ends 36 may be press-fit tails, surface mount tails, or fusible elements such as solder balls, which are configured to electrically connect to a complementary electrical component such as a substrate 38 which is illustrated as a printed circuit board. The substrate 38 can be provided as a backplane, midplane, daughtercard, or the like.

Because the mating interface 26 is substantially parallel to the mounting interface 28, the first electrical connector 22 can be provided as a vertical connector, though it should be appreciated that the first electrical connector can be provided in any desired configuration so as to electrically connect the substrate 38 to the second electrical connector 24. For instance, the first electrical connector 22 can be provided as a header connector or a receptacle connector, and can be arranged as a vertical or mezzanine connector or a right-angle connector as desired.

With continuing reference to FIGS. 1-2B, the second electrical connector 24 includes a plurality of insert molded leadframe assemblies (IMLAs) 40 that are carried by an electrical connector housing 43. Each IMLA 40 carries a plurality of electrical contacts, such as right angle electrical contacts 44. Any suitable dielectric material, such as air or plastic, may be used to isolate the right angle electrical contacts 44 from one another. The right angle electrical contacts 44 define a respective receptacle mating ends 46 that extend along the mating interface 30, and a mounting ends 48 that extend along the mounting interface 32. Each mating end 46 extends horizontally forward along a longitudinal or first direction L, and the IMLAs 40 are arranged adjacent each other along a lateral or second direction A that is substantially perpendicular to the longitudinal direction L.

Each mounting end 48 extends vertically down along a transverse or third direction T that is perpendicular to both the lateral direction A and the longitudinal direction L. Thus, as illustrated, the longitudinal direction L and the lateral direction A extend horizontally as illustrated, and the transverse direction T extends vertically, though it should be appreciated that these directions may change depending, for instance, on the orientation of the electrical connector 24 during use. Unless otherwise specified herein, the terms "lateral," "longitudinal," and "transverse" as used to describe the orthogonal directional components of various components and do not limit to specific differential signal pair configurations. The terms "inboard" and "inner," and "outboard" and "outer" with respect to a specified directional component are used herein with respect to a given apparatus to refer to directions along the directional component toward and away from the center apparatus, respectively.

The receptacle mounting ends 48 may be constructed similar to the header mounting ends 36, and thus may include press-fit tails, surface mount tails, or fusible elements such as solder balls, which are configured to electrically connect to a complementary electrical component such as a substrate 42 which is illustrated as a printed circuit board. The substrate 42 can be provided as a backplane, midplane, daughtercard, or the like. The receptacle mating ends 46 are configured to electrically connect to the respective header mating ends 34 of the first electrical connector 22 when the respective mating interfaces 26 and 30 are engaged.

The right angle electrical contacts 44 may have a material thickness of about 0.1 mm to 0.5 mm and a contact height of about 0.1 mm to 0.9 mm. The contact height may vary over the length of the right angle electrical contacts 44. The second electrical connector 24 also may include an IMLA organizer 50 that may be electrically insulated or electrically conductive. An electrically conductive IMLA organizer 50 that retains the IMLAs 40 may be electrically connected to electrically conductive portions of the IMLAs 40 via slits 52 defined in the IMLA organizer 50 or any other suitable connection.

Because the mating interface 30 is substantially perpendicular to the mounting interface 32, the second electrical connector 24 can be provided as a right-angle connector, though it should be appreciated that the first electrical connector can be provided in any desired configuration so as to electrically connect the substrate 42 to the first electrical connector 22. For instance, the second electrical connector 24 can be provided as a receptacle connector or a header connector, and can be arranged as a vertical or mezzanine connector or a right-angle connector as desired. When the connectors 22 and 24 are mounted onto their respective substrates 38 and 42 and electrically connected to each other, the substrates are placed in electrical communication.

Figure 3A:
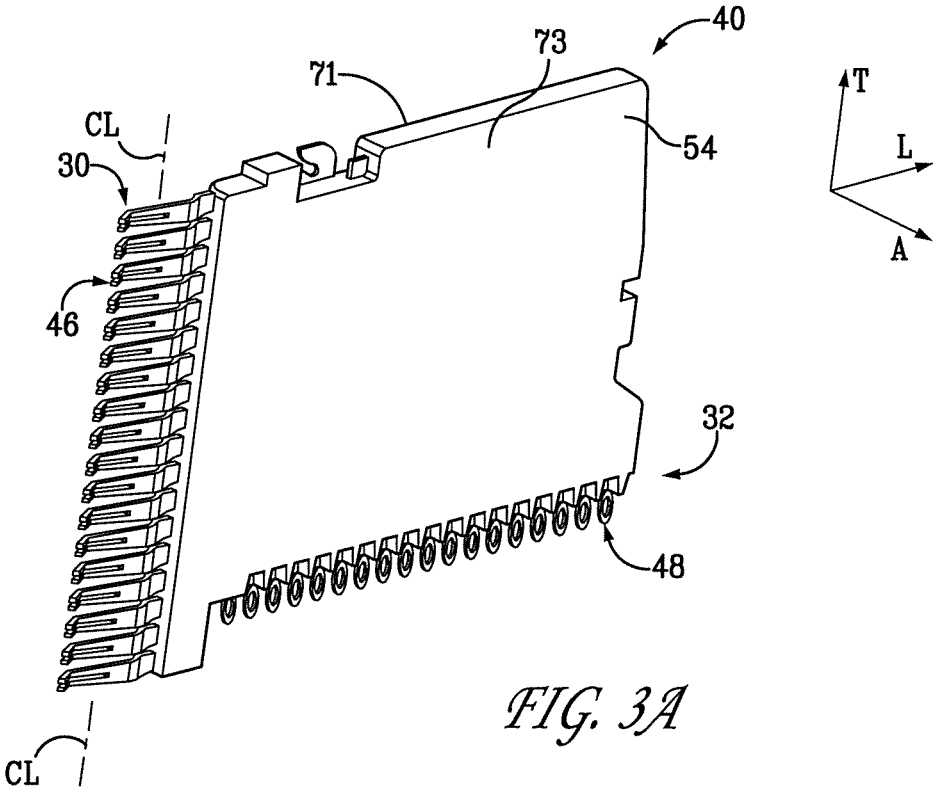
FIG. 3A is a perspective view of one of the IMLAs illustrated in FIGS. 2A-B.
Figure 3B:
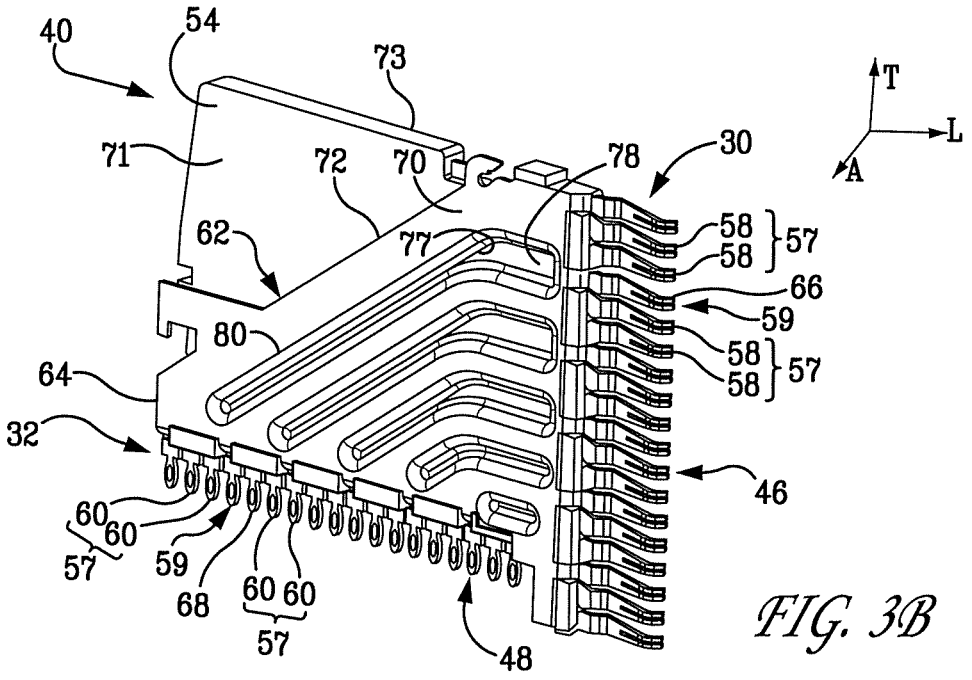
FIG. 3B is another perspective view of the IMLA illustrated in FIG. 3A showing the ground plate.
Figure 3C:
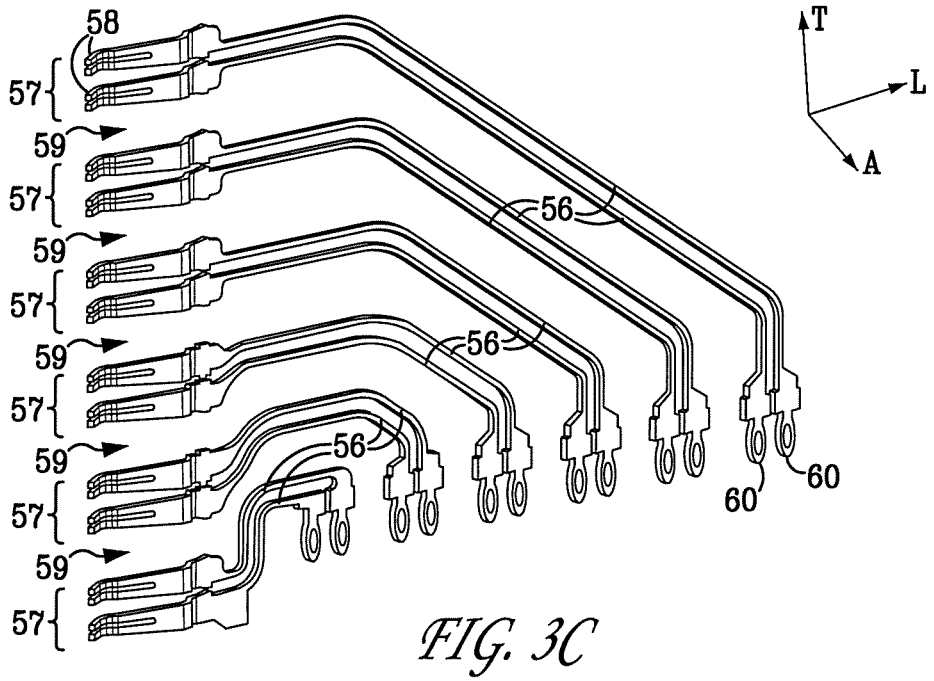
FIG. 3C is a perspective view of the electrical signal contacts of the IMLA illustrated in FIG. 3A, showing the electrical signal contacts arranged as supported by the leadframe housing.

Referring now also to FIGS. 3A-C, Each IMLA 40 includes a leadframe housing 54 which can be provided as a dielectric housing that defines laterally opposed outer surfaces 71 and 73. The leadframe housing can be made of any suitable dielectric material such as plastic, and carries a plurality of electrical signal contacts 56 form right-angle contacts which can be overmolded by the housing 54, or can alternatively can be stitched or otherwise attached in the housing 54. Each signal contact 56 includes a mating end 58 and a mounting end 60. The mating ends 58 of the signal contacts 56 are aligned along the transverse direction T, and the mounting ends 60 of the signal contacts 56 are aligned along the longitudinal direction L. The signal contacts 56 are arranged in pairs 57 (see also FIGS. 6B-C), which can be differential signal pairs. Alternatively, the signal contacts 56 can be provided as single-ended signal contacts. One or more up to all of adjacent pairs 57 of signal contacts 56 are separated by a gap 59.

Figure 4A:
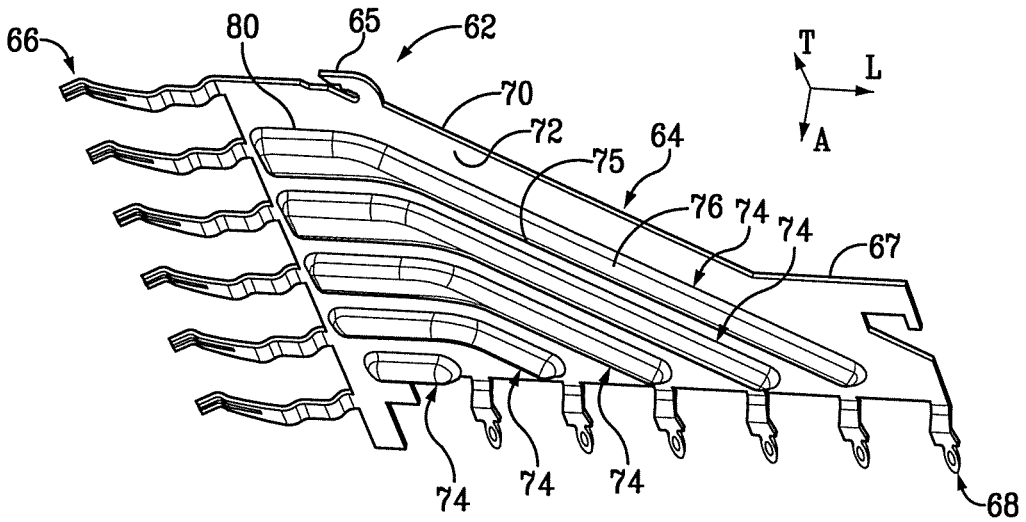
FIG. 4A is a perspective view of the ground plate illustrated in FIG. 3B.
Figure 4B:
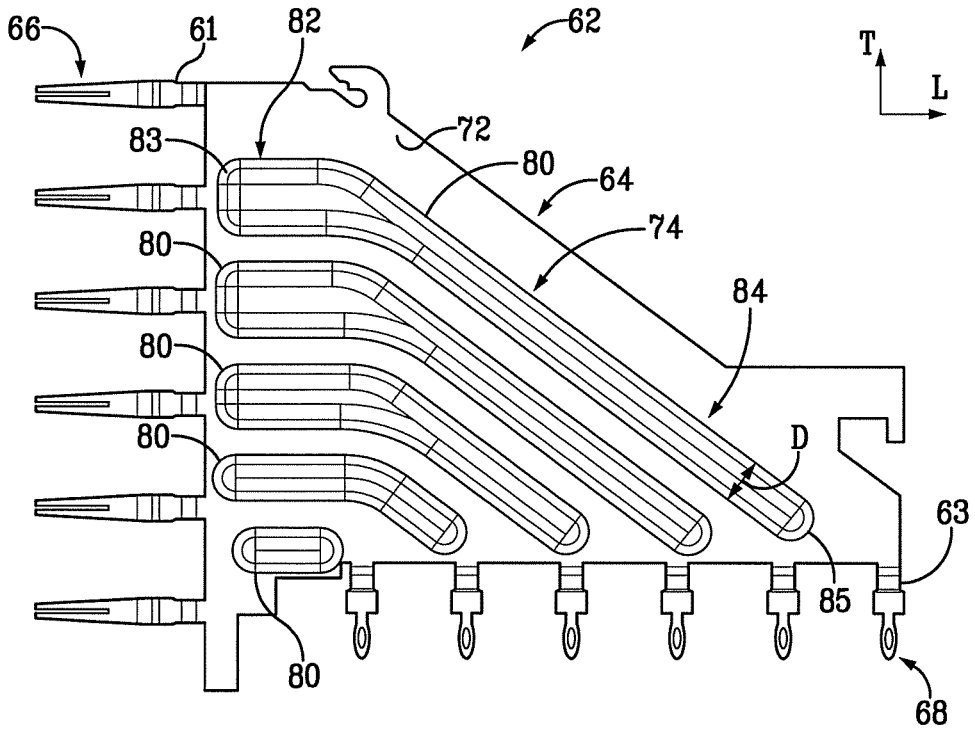
FIG. 4B is a side elevation view of the ground plate illustrated in FIG. 4A.
Figure 5A:
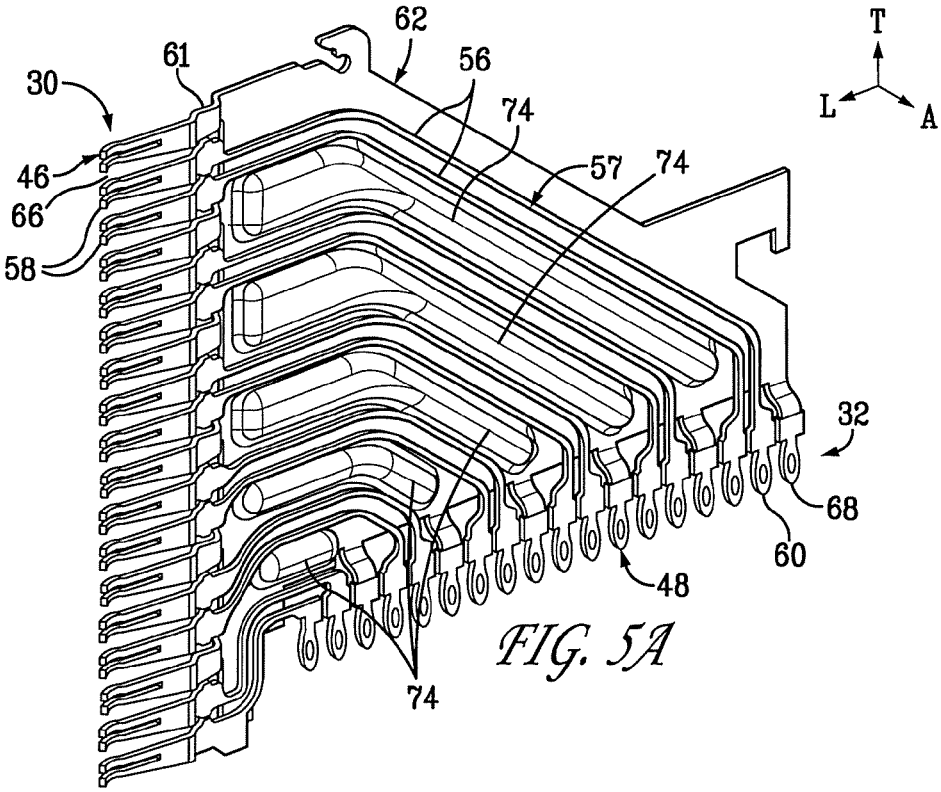
FIG. 5A is a perspective view of the IMLA as illustrated in FIG. 3A but with the leadframe housing removed.
Figure 5B:
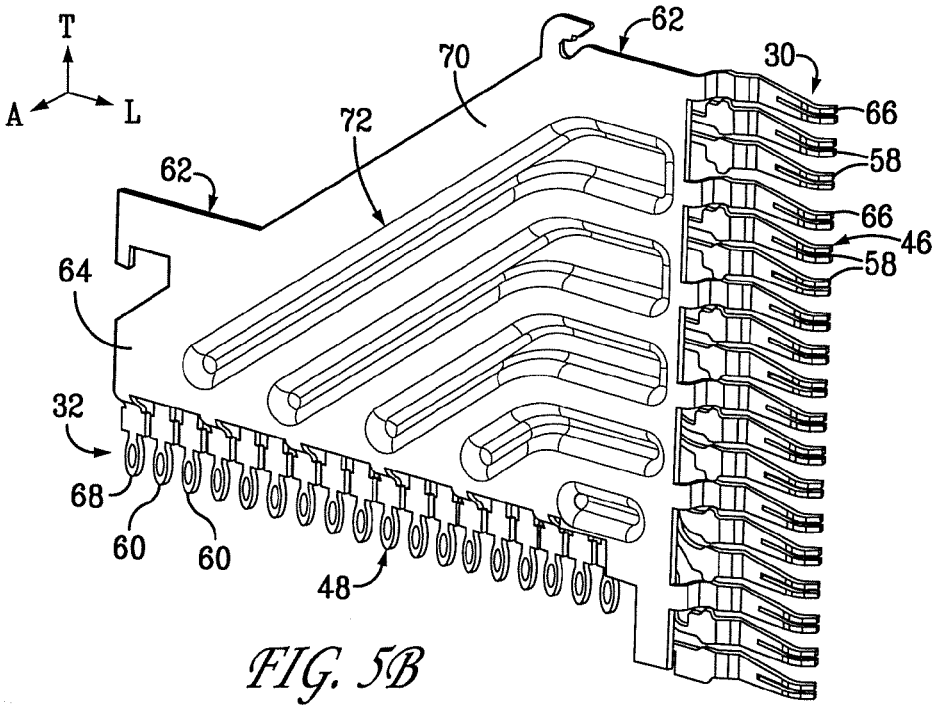
FIG. 5B is a perspective view of the IMLA as illustrated in FIG. 3B but with the leadframe housing removed.

Each IMLA 40 further includes a ground plate 62 that is carried by the leadframe housing 54. The ground plate 62 can be formed from any suitable electrically conductive material, such as a metal, and includes a body 64, a plurality of mating ends 66 extending forward from the body 64, and a plurality of mounting ends 68 extending down from the body. The mating ends 66 and mounting ends 68 can be constructed as described above with respect to the mating ends 58 and 60 of the electrical signal contacts 56. The ground plate 62 can be discretely attached to the housing 54 or overmolded by the housing 54. Referring now also to FIGS. 4A-B, the body 64 of the ground plate 62 defines an inner or first surface 72 and an outer or second surface 70 that is laterally opposed with respect to the inner surface 72. The outer surface 70 can be flush with, can protrude past, or can be inwardly recessed with respect to the corresponding outer surface 71 of the leadframe housing 54. Accordingly, the dimensions of the electrical connector 24 can remain unchanged with respect to electrical connectors whose IMLAs carry discrete ground contacts, for instance as described in U.S. Pat. No. 7,497,736, the disclosure of which is hereby incorporated by reference as if set forth in its entirety herein. The inner surface 72 faces the electrical signal contacts 56 of the IMLA 40. The ground plate 62 can further include at least one engagement member configured to attach to the organizer, such as upper or first hook 65 and a rear or second hook 67.

The ground plate 62 can be electrically conductive, and thus configured to reflect electromagnetic energy produced by the signal contacts 56 during use, though it should be appreciated that the ground plate 62 could alternatively be configured to absorb electromagnetic energy. For instance the ground plate 62 can be made from one or more ECCOSORB® absorber products, commercially available fro Emerson & Cuming, located in Randolph, Mass. The ground plate 62 can alternatively be made from one or more SRC Polylron® absorber products, commercially available from SRC Cables, Inc, located in Santa Rosa, Ca. Furthermore, the ground plates 62 are disposed between the signal contacts 56 of adjacent IMLAs, the ground plates 62 can provide a shield that reduces cross-talk between signal the signal contacts 56 of adjacent IMLAs 40.

The mating ends 66 of the ground plate 62 define ground mating ends, while the mounting ends 68 of the ground plate 62 define ground mounting ends. The mating ends 66 are aligned along the transverse direction T, and are further aligned with the mating ends 58 along the transverse direction T. The mounting ends 68 are aligned along the longitudinal direction L, and are aligned with the mounting ends 60 along the longitudinal direction L. The mating ends 66 are positioned adjacent and/or between pairs 57 of mating ends 58, and the mounting ends 68 are positioned adjacent and/or between pairs of mounting ends 60. Thus, the mating ends 46 of the electrical connector 24 include both the mating ends 58 and the mating ends 66, and the mounting ends 48 of the electrical connector 24 include both the mounting ends 60 and the mounting ends 68.

In accordance with the illustrated embodiment, the mating ends 66 of the ground plate 62 are disposed in the gap 59 that extends between adjacent pairs 57 of mating ends 58, such that the mating ends 46, which includes mating ends 58 and 66, are equidistantly spaced along the mating interface 30 of the electrical connector 24. Likewise, the mounting ends 68 of the ground plate 62 are disposed in the gap 59 that extends between adjacent pairs of mounting ends 60, such that the mounting ends 48, which includes the mounting ends 60 and 68, are equidistantly spaced along the mounting interface 32 of the electrical connector 24.

The pairs 57 of electrical signal contacts 56 may be differential signal pairs, or the signal contacts 56 can be provided as single-ended contacts. The signal contacts 56 are positioned edge-to-edge along a common centerline CL. Six differential signal pairs 57 are illustrated, however the connector 24 can include any number of differential signal pairs extending along the centerline CL, such as two, three, four, five, six, or more.

Referring now to FIGS. 4A-5B, the ground plate 62 includes at least one rib 74, such as a plurality of ribs 74 supported by the plate body 64. In accordance with the illustrated embodiment, each rib 74 is stamped or embossed into the body 64, and is thus integral with the body 64. Thus, the ribs 74 can further be referred to as embossments. As illustrated, each rib 74 defines a first surface 75 that defines a projection 76 extending laterally inwardly (e.g., into the IMLA 40) from the inner surface 72, and an opposed second surface 77 that defines a corresponding divot 78 or recessed surface extending into the outer surface 70 of the ground plate body 64. Otherwise stated, the body 64 includes a plurality of projections 76 projecting laterally from the inner surface, and further includes a plurality of divots 78, corresponding to the plurality of projections 76, recessed in the outer surface 70. The ribs 74 define respective enclosed outer perimeters 80 that are spaced from each other along the ground plate body 64. Thus, the ribs 74 are fully contained in the plate body 64.

The ribs 74 define a front or first portion 82 disposed proximate to the mating ends 66, and a rear or second portion 84 that is disposed proximate to the mounting ends 68. The front and rear portions 82 and 84 define a respective front or first terminal end 83, and a rear or second terminal end 85. The ribs 74 thus define a length extending between the first end second terminal ends 83 and 85. As illustrated, the ribs 74 can have different lengths along the ground plate body 64. For instance, those ribs 74 disposed at an upper or first end of the ground plate body 64 are longer than the ribs 74 that are disposed at a lower or second end of the ground plate body 64. In accordance with the illustrated embodiment, the length of each ribs 74 decreases along a direction from the upper or first end to the lower or second end of the ground plate body 64.

The ribs 74 can extend along a direction that includes one or more of a horizontal or longitudinal direction, a vertical or transverse direction, and an angled direction having both longitudinal and transverse directional components. For instance, as illustrated, the front portions 82 of some of the ribs 74 extend along a longitudinal rearward or direction from a location proximate to the mating ends 66 to the rear portion 84. The rear portion 84 extends along a second direction that is laterally rearward and transversely down from the front portion 82 to a location proximate to the mounting ends 68. The rear portion 84 extends at an angle between 90° and 180° with respect to the front portion 82. It should be appreciated that one or more of the ribs 74, for instance the bottommost rib 74 shown in FIG. 4B, extends only longitudinally. It should be further appreciated that one or more of the ribs 74 can further extend along a third transverse direction, for instance at a location proximate to the mounting ends 68.

Referring now to FIGS. 4A-6C, the electrical signal contacts 56 are aligned or arranged in a first transverse-longitudinal plane T-L1 that includes the common centerline CL, and the ground plate body 64 is oriented in a second transverse-longitudinal ground plane T-L2 that extends substantially parallel to the first plane T-L1, and is laterally outwardly offset or spaced from the first plane T-L1. The projection 76 of each rib 74 extends laterally inward from the inner surface 72 of the ground plate body 64 toward the first plane T-L1. The projections 76 can extend laterally from the inner surface 72 a distance sufficient such that a portion of each projections 76 extends into the first plane T-L1 and is thus co-planar with the signal contacts 56 (or a portion of the signal contacts 56), but less than the thickness of the leadframe housing 54 such that the projections 76 are recessed with respect to the outer surface 73 (see FIG. 3B). The projections 76 are aligned with the gaps 59 disposed between adjacent pairs 57 of signal contacts 56, such that the portion of each projection 76 that extends into the first plane T-L1 between adjacent pairs 57 is disposed in a corresponding one of the gaps 59.

The ground plate 62 includes a first neck 61 extending between the ground plate body 64 and each mating end 66, and a second neck 63 extending between the ground plate body 64 and each mounting end 68. In particular, each first neck 61 extends laterally inward from the second plane T-L2 toward the first plane T-L1 along a longitudinally forward direction from the ground plate body 64, such that the mating ends 66 lie in the first plane T-L1 and are thus co-planar with the mating ends 58 of the signal contacts 56. Likewise, the second neck 63 extends laterally inward from the second plane T-L2 toward the first plane T-L1 along a transversely downward direction from the ground plate body 64, such that the mounting end 68 lies in the first plane T-L1, and is thus co-planar with the mounting ends 60 of the signal contacts 56.

Each rib 74 defines a cross-sectional distance D that extends along the second plane T-L2 in a direction normal to the outer perimeter 80. The distance D can be consistent along the length of a given rib 74, as illustrated in the lowermost rib 74 shown in FIG. 4A. Alternatively, the distance D can vary along the length of a given rib between the front and rear ends 83 and 85, respectively. For instance, the distance D can be smaller at the rear portion 84 than at the front portion 82. Otherwise stated, the distance D can increase along the length of the rib 74 from the rear portion 84 to the front portion 82. Likewise, the gap 59 disposed between adjacent pairs 57 of signal contacts 56 can increase along a direction from the mounting ends 60 toward the mating ends 58 so as to accommodate the increasing cross-sectional distance D of the ribs 74.

Figure 6A:
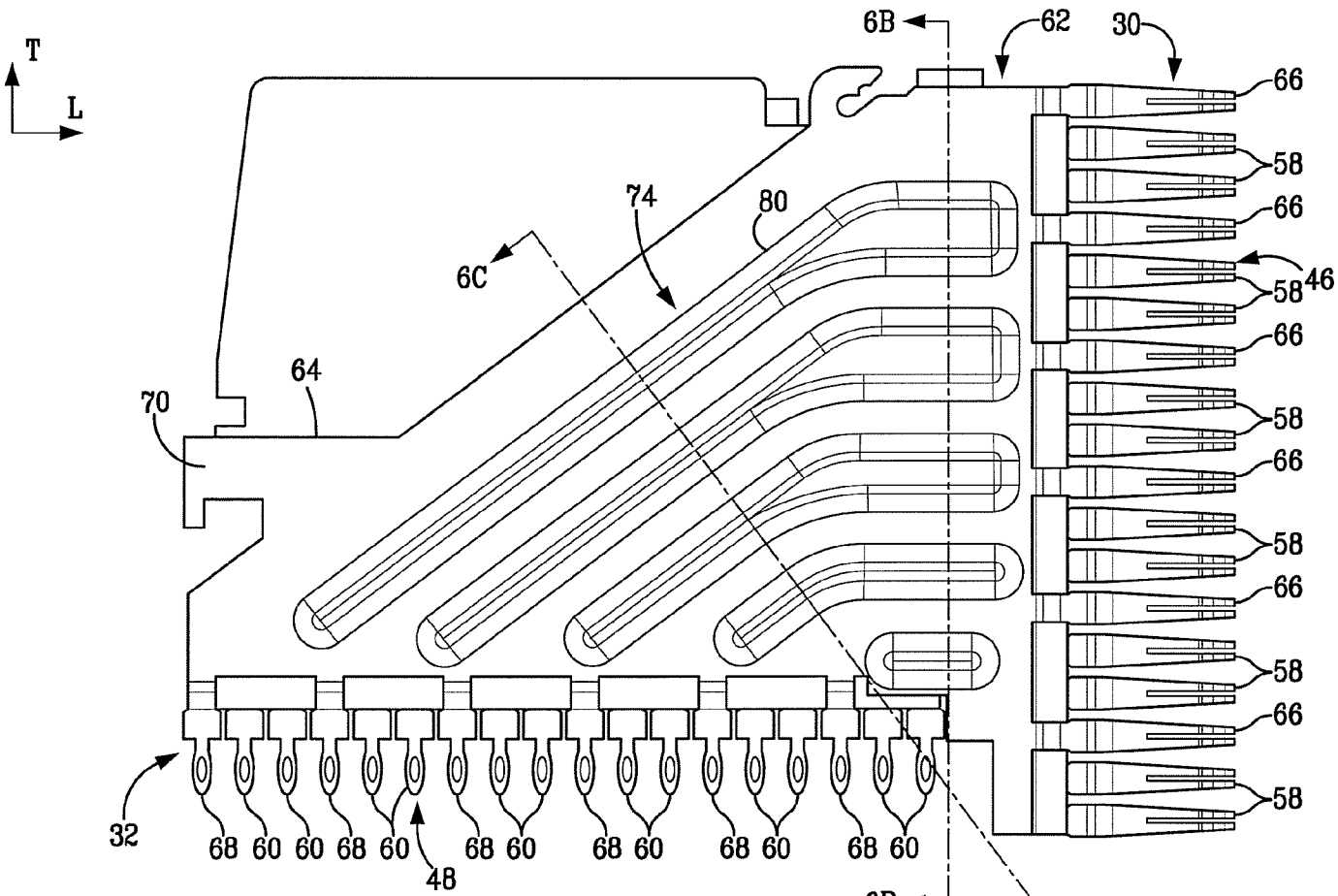
FIG. 6A is a side elevation view of the IMLA illustrated in FIG. 3B.
Figure 6B:
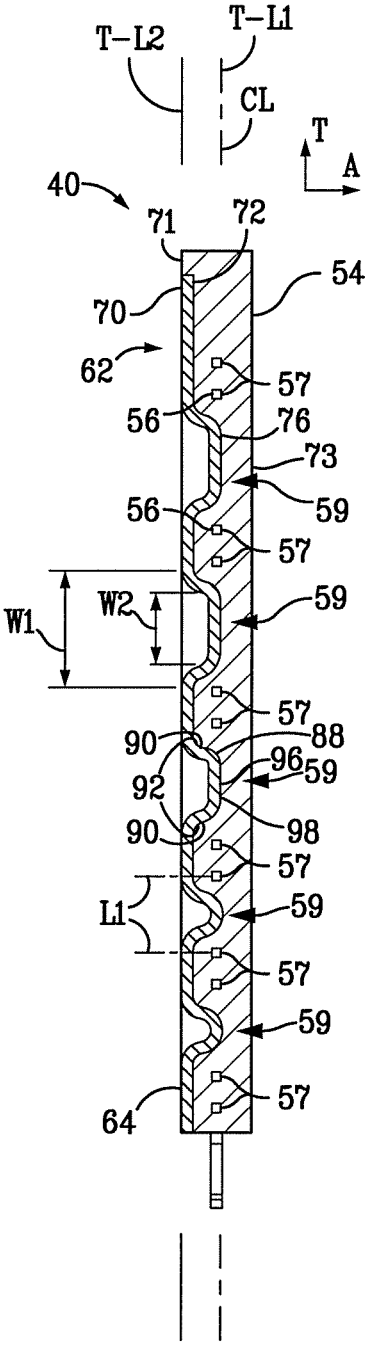
FIG. 6B is a sectional view of the IMLA illustrated in FIG. 6A, taken along line 6B-6B.
Figure 6C:
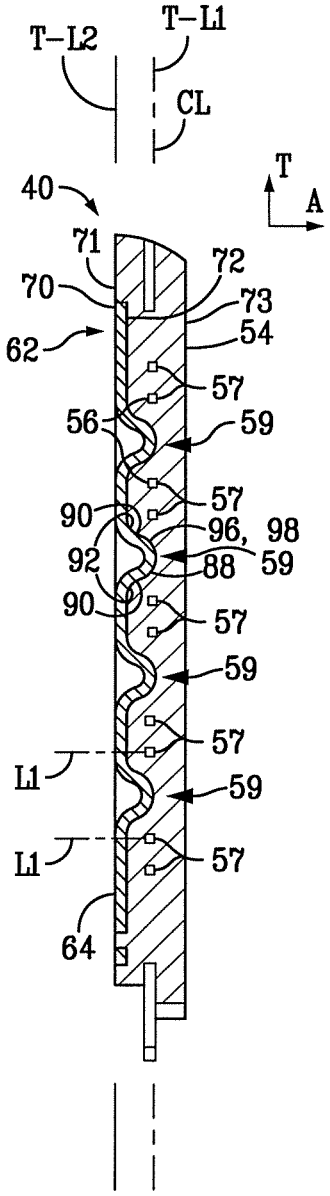
FIG. 6C is a sectional view of the IMLA illustrated in FIG. 6A, taken along line 6C-6C.

With continuing reference to FIGS. 4A-6C, and in particular to FIGS. 6B-C, each rib 74 can include at least one wall 88. The wall 88 includes opposed outer wall portions 90 that each extend laterally from the inner surface 72 at the outer perimeter 80, and can converge toward each other along their direction of extension from the inner surface 72. When the ground plate 62 is installed in the IMLA, the outer wall portions 90 extend into a corresponding one of the gaps 59 between adjacent pairs 57 of signal contacts 56. As illustrated, the outer wall portions 90 can be beveled or curved. Furthermore, the curvature of each rib 74 can vary along its length. The outer wall portions 90 define from a proximal end 92 of the rib 74, and terminate at a middle wall portion 96 that is connected between the outer wall portions 90. The proximal end 92 of the rib 74 is the portion of the rib 74 that extends from the inner surface 72 at a location proximate to the inner surface 72.

The middle wall portion 96 is thus disposed at a location that is laterally offset with respect to the inner surface 72 of the ground plate body 64. In accordance with the illustrated embodiment, the middle wall portion 96 defines a distal end 98 of the rib 74 that lies in the first plane T-L1. The middle wall portion 96 can include a curved portion along a direction extending normal to the signal contacts 56 that define the corresponding gap 59, or can alternatively or additionally include a flat portion along a direction extending normal to the signal contacts 56 that define the gap 59. In this regard, it should be appreciated that the middle wall portion 96 can alternatively be entirely curved along a direction extending normal to the signal contacts 56 that define the corresponding gap 59, or entirely flat along a direction extending normal to the signal contacts 56 that define the gap 59. Thus, the ribs 74 can define curvatures that vary from each other. It should thus be appreciated that the ribs 74 can be curved or tapered, and thus devoid of sharp edges that are out of plane T-L1 with respect to the differential signal contacts 56. Furthermore, each rib 74 can be spaced at a consistent distance along its length from its adjacent signal contacts 56 that define the corresponding gap 59. Moreover, each rib 74 can be spaced from its adjacent signal contacts 56 a distance that is substantially equal to the distance that one or more up to all of the other ribs 74 are spaced from their adjacent signal contacts.

While the middle wall portion 96 can lie in the first plane T-L1 as illustrated, it should be appreciated that the rib 74 could alternatively terminate at the distal end 98 which is positioned inward of, or past, the first plane T-L1. In accordance with the illustrated embodiment, the middle wall portion 96 extends at substantially a constant lateral distance LD from the inner surface 72 of the ground plate 62 that is substantially equal to the lateral distance between the second plane T-L2 and the first plane T-L1.

It should be appreciated that a portion of each rib 74 can overlap the electrical signal contacts 56 that define the corresponding gap 59 with respect to an axis extending through the signal contacts 56 in a direction perpendicular to and between the first and second planes T-L1 and T-L2. Alternatively, the ribs 74 can be wholly contained between the axes extending through the signal contacts 56 in a direction perpendicular to and between the first and second planes T-L1 and T-L2. For instance, In accordance with the illustrated embodiment, the proximal end 92 of each rib 74 is positioned inward with respect to the corresponding signal contacts 56 that define the gap 59. Accordingly, a lateral axis L1 that extends through the proximal ends 92 one or more ribs 74 also extends through the corresponding gap 59, and not one of the signal contacts 56 that defines the gap 59. Alternatively, the proximal ends 92 could be disposed outward or inline with respect to the corresponding signal contacts 56 that define the gap 59. Accordingly, the lateral axis L1 that extends through the proximal ends 92 or other locations of the rib 74 can also extend through one or both signal contacts 56 that defines the corresponding gap 59.

With continuing reference to FIGS. 4A-6C, each rib 74 can define a first width W1 extending along a direction parallel to the ground plate plane T-L2 at the proximal end 92, and a second width W2 extending along the direction parallel to the ground plate plane T-L2 at the distal end 98 that is less than the first width W1 in accordance with the illustrated embodiment. The widths W1 and W2 of at least one rib 74 can be less than, greater than, or substantially equal to one or both of the corresponding widths W1 and W2 of one or more of the other ribs 74.

Figure 8:
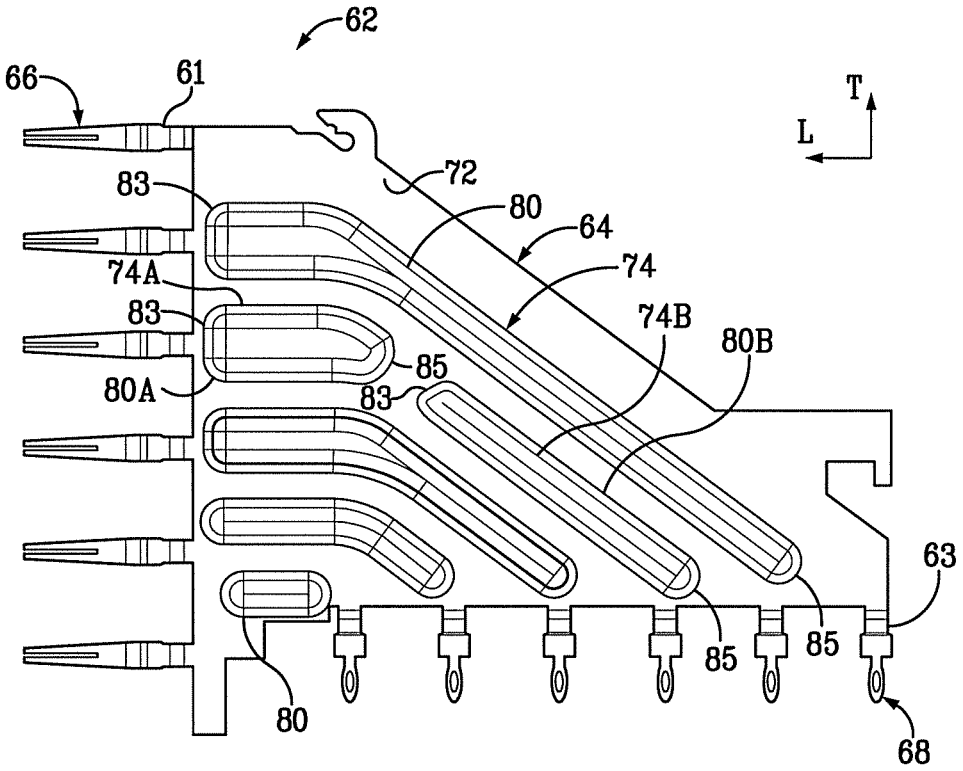
FIG. 8 is a side elevation view of a ground plate similar to the ground plate illustrated in FIG. 4B, but constructed in accordance with an alternative embodiment.

While the ribs 74 are illustrated as extending continuously from their respective front end 83 to their rear ends 85, it should be appreciated that one or more up to all of the ribs 74 can be discontinuous or segmented between the front and rear ends 83 and 85. For instance, as illustrated in FIG. 8, one or more the ribs 74 can be provided as separate rib segments 74*a* and 74*b*, each defining respective enclosed perimeters 80*a* and 80*b* spaced from each other between the corresponding mating end 66 and mounting end 68. Alternatively or additionally, the middle wall portion 96 of a given rib 74 can project a distance from the inner surface 72 that varies along the length of the rib 74 between the front end 83 and the rear end 85.

While FIGS. 6B-C show the leadframe housing 54 overmolded onto the signal contacts 56 and the ground plate 62, it should be appreciated that the signal contacts 56, the ground plate 62, or both the signal contacts 56 and the ground plate 62 can be discreetly attached to the leadframe housing 54. Furthermore, while the ground plate 62 is shown as abutting the leadframe housing 54 along its length, the ground plate 62 can alternatively be supported by the leadframe housing 54 at discrete locations of the ground plate 62, such that one or more air gaps are disposed between the housing 54 and the ground plate 62 and desired locations. For instance, an air gap between the leadframe housing 54 and the ribs 74 would allow for clearance of the ribs 74 when the ground plate 62 is attached to the leadframe housing 54. It should be further appreciated that such air gaps could further be provided when the leadframe housing 54 is overmolded onto the ground plate 62. Likewise, while the signal contacts 56 are shown as abutting the leadframe housing 54 along their length, the signal contacts 56 can alternatively be supported by the leadframe housing 54 at discrete locations of the signal contacts 56, such that air gaps are disposed between the housing 54 and the signal contacts and desired locations. It should be further appreciated that such air gaps could further be provided when the leadframe housing 54 is overmolded onto the signal contacts 56.

Figure 7A:
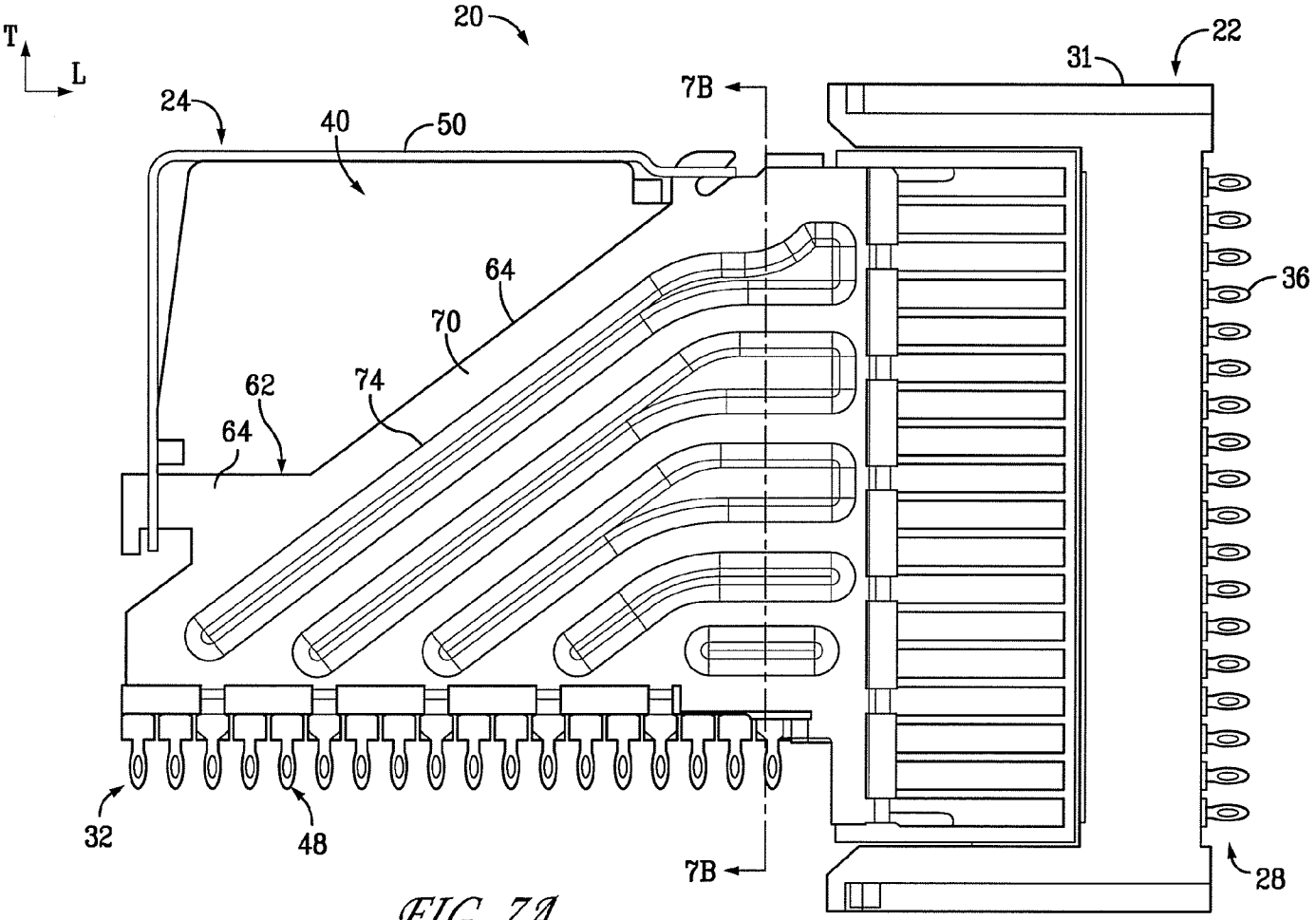
FIG. 7A is a side elevation view of the electrical connector assembly as illustrated in FIG. 2B.
Figure 7B:
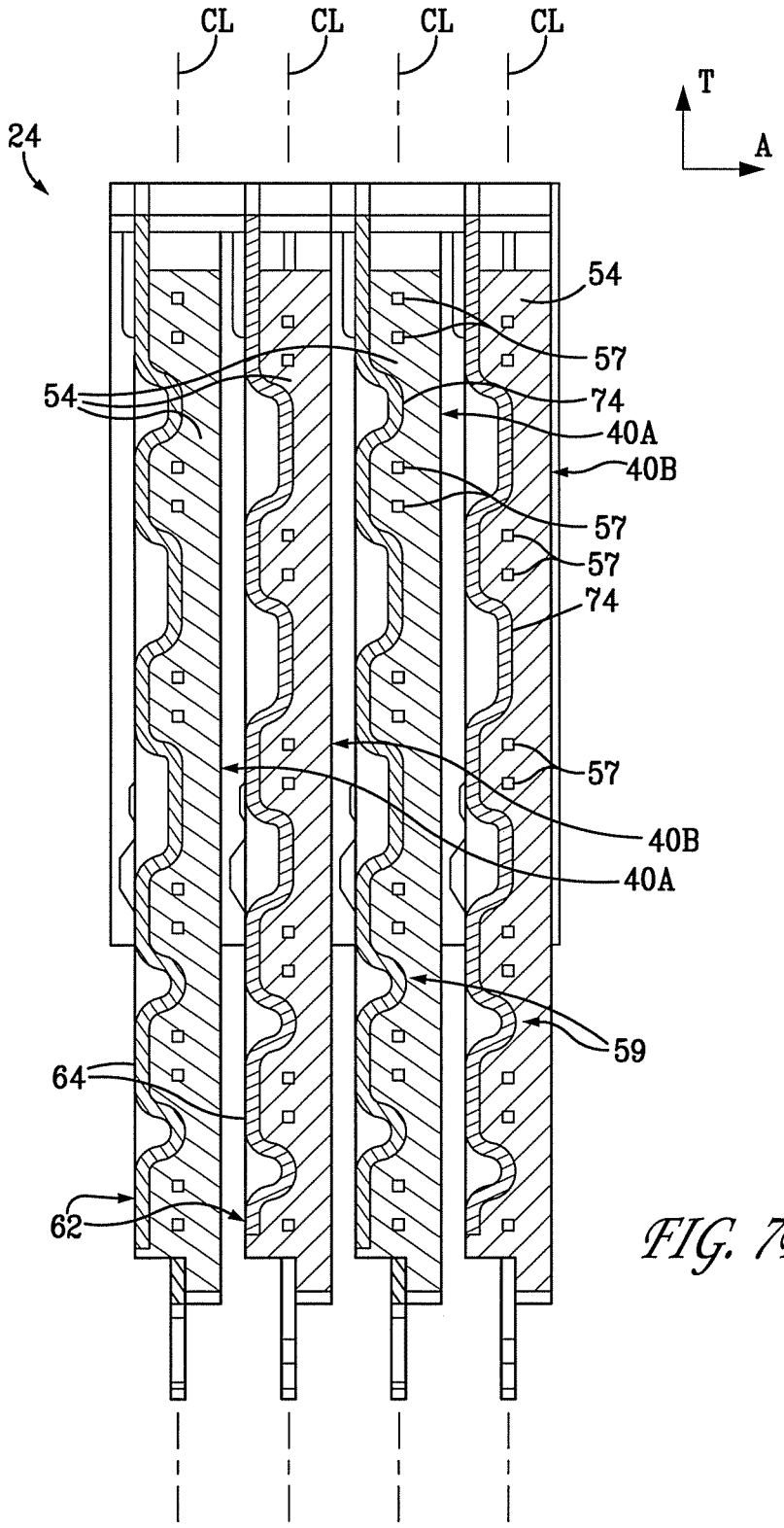
FIG. 7B is a sectional view of the electrical connector assembly illustrated in FIG. 7A, taken along line 7B-7B.

Referring now to FIGS. 7A-B, the electrical connector 24 is illustrated as including a plurality of IMLAs 40 of the type described above. Four IMLAs 40 are illustrated having electrical contacts 44 that extend along respective common centerlines CL, though it should be appreciated that the connector 24 can include as many IMLAs 40 as desired. Each IMLA can include as many electrical signal contact pairs 57 and interleaved ribs 74 as desired. Thus, one or more up to all of the IMLAs 40 can include a ground plate 62 of the type described above. The IMLAs 40 include a first-type of IMLAs 40A that are substantially identically constructed and a second type of IMLAs 40B that substantially identically constructed. The IMLAs 40A and 40B are alternately arranged along the lateral direction A. In accordance with the illustrated embodiment, the signal contacts 56 of the first IMLAs 40A are staggered with respect to the signal contacts 56 of the second IMLAs 40B. Accordingly, the gaps 59 between adjacent signal pairs 57 of the first IMLAs 40*a* are staggered with respect to the gaps 59 of the second IMLAs 40B. It should be appreciated that the mating ends 66 and mounting ends 68 can extend from any position along the ground plate body 64 as desired, such that the mating ends 66 are disposed between and aligned with the mating ends 58 of the signal contacts 56 in the manner described above, and the mounting ends 68 are disposed between and aligned with the mounting ends 60 of the signal contacts 56 in the manner described above.

For instance, in accordance with one embodiment, the mating ends 46 of the first IMLAs 40A are arranged in a repeating G-S-S-G-S-S pattern in a direction along the common centerline CL from the top of the mating interface 30 toward the bottom of the mating interface 30, whereby "G" denotes electrical ground contact mating ends 66 and "S" denotes electrical signal contact mating ends 58. Furthermore, in accordance with one embodiment, the mating ends 46 of the second IMLAs 40B are arranged in a repeating S-S-G-S-S-G pattern in a direction along the common centerline CL from the top end of the mating interface 30 toward the bottom of the mating interface 30, whereby "G" denotes electrical ground contact mating ends 66 and "S" denotes electrical signal contact mating ends 58.

It should thus be appreciated that a method of producing an electrical connector includes the steps of 1) providing a plurality of electrical signal contacts 56, 2) retaining the electrical signal contacts 56 in the leadframe housing 54 along the first plane T-L1 so as to define gaps 59 disposed between adjacent pairs of electrical signal contacts 56, 3) providing a ground plate 62 having a ground plate body 64 that defines first and second opposed surfaces 72 and 70, respectively, 4) stamping a plurality of ribs 74 into the second surface 70 of the ground plate body 64 such that the ribs 74 define first and second opposed surfaces 75 and 77, respectively, wherein the first surface 75 of each rib 74 projects out from the first surface 72 of the ground plate body 64, and the second surface 77 of each rib is recessed in the second surface 70 of the ground plate body 64, and 5) attaching the ground plate 62 to the leadframe housing 54 such that the ground plate body 64 is oriented in the second plane T-L2 that is offset with respect to the first plane T-L1, and the first surface 75 of each rib 74 projects toward a respective one of the gaps 59 defined by the adjacent pairs 57 of electrical signal contacts 56.

The ground plate 62 is a wide continuous conductor, and is wider than the ground contacts of an electrical connector that is substantially identical with respect to the electrical connector 24, with the exception that the substantially identical electrical connector does not include the ground plate 62, but instead includes discrete ground contacts extending in the gaps 59 that define opposing ground mating ends and ground mounting ends as described in U.S. Pat. No. 7,497,736. Accordingly, it should be appreciated that the electrical connector 24 can be modified with respect to substantially identical electrical connector, with the exception that the electrical connector 24 is devoid of discrete ground contacts in favor of the ground plate 62 having ribs 74 that extend between adjacent pairs 57 of signal contacts 56. Thus, the electrical connector 24 is an improvement over shieldless, high density, right-angle electrical connectors that have discrete ground contacts without significantly lowering impedance matching and without significantly increasing inductance. In accordance with embodiments of the present invention, the impedance of the electrical connector 24 is not significantly altered with respect to a pre-modified connector, inductance of the electrical connector 24 is lower than the ground contacts in the same pre-modified connector, crosstalk of the electrical connector 24 is lower as compared to the same pre-modified connector, and the overall dimensions of the electrical connector 24 are the same as those of the pre-modified connector For instance, it is believed that the ground plate 62 provides a low-impedance common path that intercepts and dissipates stray electro-magnetic energy between signal contacts 56 that otherwise would have been a source for cross talk. It is believed that a connector that incorporates the IMLAs 40 as described above can operate at 13 GHz with acceptable worst-case, multi-active crosstalk on a victim pair of no more than six percent, for instance less than one percent, such as 0.4 percent. Worst case, multi-active crosstalk may be determined in the manner described in U.S. Pat. No. 7,497,736.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. Those skilled in the relevant art, having the benefit of the teachings of this specification, may effect numerous modifications to the invention as described herein, and changes may be made without departing from the spirit and scope of the invention as defined by the appended claims.

What is claimed:

1. A vertical electrical connector comprising:

a dielectric housing defining a mating interface and a mounting interface that is spaced from the mating interface along a longitudinal direction, wherein the mounting interface extends substantially parallel to the mating interface;

a plurality of electrical signal contacts carried by the dielectric housing and arranged along a first plane, wherein the signal contacts define signal pairs such that a respective gap is disposed between adjacent signal pairs, and the electrical signal contacts further define respective mating ends that are positioned along the mating interface and mounting ends that are positioned along the mounting interface;

a ground plate carried by the dielectric housing, the ground plate including a ground plate body oriented in a second plane that is substantially parallel to the first plane and offset from the first plane, the ground plate body defining first and second opposed surfaces, the ground plate including at least one rib that is elongate along the longitudinal direction, the rib defining first and second opposed surfaces, wherein the first surface of the rib projects from the first surface of the ground plate body in a direction toward the gap, and the second surface is recessed into the second surface of the ground plate body, and the ground plate includes respective mating ends and mounting ends that extend from the ground plate body, the mating ends of the ground plate positioned along the mating interface, and the mounting ends of the ground plates positioned along the mounting interface;

wherein the dielectric housing is a leadframe housing that supports the electrical signal contacts.

2. The vertical electrical connector as recited in claim 1, wherein the leadframe housing is overmolded onto the electrical signal contacts.

3. The vertical electrical connector as recited in claim 1, wherein the ground plate is discretely attached to the leadframe housing.

4. The vertical electrical connector as recited in claim 1, wherein the ground plate is overmolded by the leadframe housing.

5. The vertical electrical connector as recited in claim 1, wherein the ground plate further comprises a plurality of ribs that each first and second opposed surfaces, wherein the first surface of the plurality of ribs rib projects from the first surface of the ground plate body in a direction toward the gap, and the second surface of each of the plurality of ribs is recessed into the second surface of the ground plate body.

6. The vertical electrical connector as recited in claim 5, wherein the pairs of electrical signal contacts comprise differential signal pairs.

7. The vertical electrical connector as recited in claim 6, wherein adjacent ones of the differential signal pairs are separated by respective gaps, and a respective one of the plurality of ribs is disposed in the gaps.

8. The vertical electrical connector as recited in claim 7, wherein the ribs are devoid of sharp edges that are out of plane with respect to the differential signal pairs.

9. The vertical electrical connector as recited in claim 1, wherein the mating ends and mounting ends of the grounding plate are disposed in the first plane.

10. The vertical electrical connector as recited in claim 1, wherein the vertical electrical connector has the same overall dimension as a substantially identically constructed electrical connector that does not include the ground plate and instead includes a discrete electrical ground contact disposed in the gap.

* * * * *